US008022288B2

(12) United States Patent
Sullivan

(10) Patent No.: US 8,022,288 B2
(45) **Date of Patent: *Sep. 20, 2011**

(54) MUSICAL INSTRUMENT

(75) Inventor: Daniel E. Sullivan, Shoreview, MN (US)

(73) Assignee: Zivix LLC, Minneapolis, MN (US)

( * ) Notice: Subject to any disclaimer, the term of this patent is extended or adjusted under 35 U.S.C. 154(b) by 63 days.

This patent is subject to a terminal disclaimer.

(21) Appl. No.: 12/548,849

(22) Filed: Aug. 27, 2009

(65) Prior Publication Data

US 2009/0314157 A1 Dec. 24, 2009

Related U.S. Application Data

(63) Continuation of application No. 11/498,996, filed on Aug. 4, 2006, now Pat. No. 7,598,449.

(51) Int. Cl.
*G10H 1/00* (2006.01)

(52) U.S. Cl. ..... 84/615; 84/646; 84/678; 84/722; 84/724

(58) Field of Classification Search ..... 84/615, 84/646, 678, 722, 724
See application file for complete search history.

(56) References Cited

U.S. PATENT DOCUMENTS

| | | | |
|---|---|---|---|
| 3,482,029 | A | 12/1969 | Sines |
| 3,786,167 | A | 1/1974 | Borell et al. |
| 4,321,852 | A | 3/1982 | Young, Jr. |
| 4,339,979 | A | 7/1982 | Norman |
| 4,372,187 | A | 2/1983 | Berg |
| 4,468,997 | A | 9/1984 | Young, Jr. |
| 4,468,999 | A | 9/1984 | Bonanno |
| 4,580,479 | A | 4/1986 | Bonanno |
| 4,653,376 | A | 3/1987 | Allured et al. |
| 4,658,690 | A | 4/1987 | Aitken et al. |
| 4,730,530 | A | 3/1988 | Bonanno |
| 4,748,887 | A | 6/1988 | Marshall |
| 4,794,838 | A | 1/1989 | Corrigau, III |
| 4,815,353 | A | 3/1989 | Christian |
| 4,858,509 | A | 8/1989 | Marshall |

(Continued)

FOREIGN PATENT DOCUMENTS

JP 04219794 8/1992

(Continued)

OTHER PUBLICATIONS

"U.S. Appl. No. 11/498,996, Response filed Jul. 28, 2008 to Non Final Office Action mailed Mar. 28, 2008", 65 pgs.

(Continued)

*Primary Examiner* — David S. Warren
(74) *Attorney, Agent, or Firm* — Schwegman, Lundberg & Woessner, P.A.

(57) ABSTRACT

A musical device is disclosed that performs a variety of user defined or user controlled activities. These activities include but are not limited to producing musical notes, determining, influencing or changing the sound, quality, voice, volume or other characteristics of a note, activating and coordinating the replay of stored loops, recording, editing and playing user created pieces previously produced and controlling peripheral devices such as lighting. The musical device uses a combination of strings and frets to locate notes on a fingerboard that a user may activate. As a result, the invention includes a system to generate a sound corresponding to a note selected and activated according to preselected parameters such as the voice (e.g., trumpet, violin). A user's intent to play a particular note can be confirmed by a system of sensors corresponding to each note position.

20 Claims, 17 Drawing Sheets

U.S. PATENT DOCUMENTS

| | | | | |
|---|---|---|---|---|
| 4,919,031 | A | 4/1990 | Matsumoto | |
| 4,951,545 | A | 8/1990 | Yoshida | |
| 4,966,053 | A | 10/1990 | Dornes | |
| 5,010,800 | A | 4/1991 | Yoshida | |
| 5,012,086 | A | 4/1991 | Barnard | |
| 5,033,351 | A | 7/1991 | Nomura | |
| 5,033,353 | A | 7/1991 | Fala et al. | |
| 5,040,447 | A | 8/1991 | Murata et al. | |
| 5,140,887 | A | 8/1992 | Chapman | |
| 5,140,890 | A | 8/1992 | Elion | |
| 5,206,449 | A | 4/1993 | McClish | |
| 5,214,232 | A | 5/1993 | Iijima et al. | |
| 5,237,126 | A | 8/1993 | Curtis et al. | |
| 5,557,057 | A | 9/1996 | Starr | |
| 5,739,455 | A | 4/1998 | Poon | |
| 6,162,981 | A | 12/2000 | Newcomer et al. | |
| 6,191,350 | B1 | 2/2001 | Okulov et al. | |
| 6,610,917 | B2 | 8/2003 | Ludwig | |
| 6,846,980 | B2 | 1/2005 | Okulov | |
| 7,112,738 | B2 | 9/2006 | Hyakutake et al. | |
| 7,223,913 | B2 | 5/2007 | Knapp et al. | |
| 7,598,449 | B2 | 10/2009 | Sullivan | |
| 7,897,866 | B2 | 3/2011 | Sullivan | |
| 2002/0005108 | A1 | 1/2002 | Ludwig | |
| 2004/0200338 | A1 | 10/2004 | Pangrie | |
| 2005/0183567 | A1 | 8/2005 | Aoki et al. | |
| 2006/0107826 | A1 * | 5/2006 | Knapp et al. | 84/724 |
| 2006/0174756 | A1 | 8/2006 | Pangrle | |
| 2007/0256551 | A1 * | 11/2007 | Knapp et al. | 84/722 |
| 2008/0028920 | A1 | 2/2008 | Sullivan | |
| 2008/0062402 | A1 | 3/2008 | Rouget et al. | |
| 2008/0141847 | A1 | 6/2008 | Komatsu et al. | |
| 2008/0282873 | A1 | 11/2008 | Kotton et al. | |
| 2009/0308232 | A1 * | 12/2009 | McMillen et al. | 84/723 |
| 2010/0083807 | A1 | 4/2010 | Sullivan | |
| 2010/0083808 | A1 | 4/2010 | Sullivan | |
| 2010/0087254 | A1 | 4/2010 | Sullivan | |

FOREIGN PATENT DOCUMENTS

| | | | |
|---|---|---|---|
| JP | 04242796 | | 8/1992 |
| WO | WO-2008019089 | A2 | 2/2008 |
| WO | WO-2008019089 | A3 | 2/2008 |
| WO | WO-2010042508 | A2 | 4/2010 |
| WO | WO-2010042508 | A3 | 4/2010 |

OTHER PUBLICATIONS

"U.S. Appl. No. 12/246,824, Response filed Jun. 1, 2010 to Restriction Requirement mailed Apr. 29, 2010", 7 pgs.

"U.S. Appl. No. 12/246,824, Restriction Requirement mailed Apr. 29, 2010", 7 pgs.

"U.S. Appl. No. 12/246,850, Non-Final Office Action mailed Dec. 2, 2009", 11 pgs.

"U.S. Appl. No. 12/246,850, Response filed Sep. 21, 2009 to Restriction Requirement mailed Aug. 19, 2009", 9 pgs.

"International Application Serial No. PCT/US2009/059687, Search Report and Written Opinion mailed Apr. 28, 2010", 11 pgs.

"U.S. Appl. No. 11/498,996, Final Office Action mailed Mar. 19, 2009", 17 pgs.

"U.S. Appl. No. 11/498,996, Non-Final Office Action mailed Mar. 26, 2008", 9 pgs.

"U.S. Appl. No. 11/498,996, Notice of Allowance mailed May 18, 2009", 4 pgs.

"U.S. Appl. No. 11/498,996, Response filed Apr. 22, 2009 to Final Office Action mailed Mar. 19, 2009", 12 pgs.

"U.S. Appl. No. 11/498,996, Response to Notice of Non-Compliant Amendment mailed Dec. 22, 2008", 23 pgs.

"U.S. Appl. No. 12/246,850, Restriction Requirement mailed Aug. 19, 2009", 6 pgs.

"International Application Serial No. PCT/US07/17383, International Search Report mailed Mar. 7, 2008", 4 pgs.

"U.S. Appl. No. 12,246,824, Non-Final Office Action mailed Jul. 6, 2010", 13 pgs.

"U.S. Appl. No. 12/246,824 Notice of Allowance mailed Oct. 29, 2010", 9 Pgs.

"U.S. Appl. No. 12/246,824, Response filed Oct. 1, 2010 to Non Final Office Action mailed Jul. 6, 2010", 14 pgs.

* cited by examiner

MUSICAL INSTRUMENT

CLAIM OF PRIORITY

This application is a continuation of U.S. application Ser. No. 11/498,996, filed Aug. 4, 2006, now U.S. Pat. No. 7,598,449 which is incorporated herein by reference in its entirety.

BACKGROUND OF THE INVENTION

1. Field of Invention

This invention relates to a musical instrument and more specifically relates to a device that in one embodiment generates digital commands that in turn are interpreted by something else to generate a sound with specific parameters or to control musical expression or other control functions that are useful in a performance setting and in another embodiment generates note tones itself.

2. Prior Art

Until the advent of an electronic means to generate sound, all musical instruments were designed to create sound by means of mechanical vibrations. This requirement constrains the physical interface of the instrument and imposes certain requirements on the musician (i.e, a louder note requires harder key presses or more breath pressure). The generation of music electronically opens up many more possibilities for musical expression, and since the invention of standard control interfaces such as the MIDI format, there now exists a new category of electronic musical instruments that are used to generate digital information regarding musical notes and expression. MIDI is by far the predominant format in this medium, but MIDI was primarily devised with the human interface of a keyboard and music synthesizer in mind. The piano-like keys of a typical synthesizer are used as switches to activate and silence note commands and the velocity of the keystroke can be measured to determine the loudness of the note.

The MIDI control language allows for other commands for the purposes of musical expression with a common one being a spring-centered slider wheel that is used to control pitch bend. This feature adds a level of expression to a keyboard that cannot be achieved with a piano, and there are other ways to influence the sound created by a keypress. These other controls are typically in the form of sliders and knobs mounted on the keyboard. But there are other innovative means to control the sound generated, such as the use of Hall effect switches in a guitar-like musical instrument (U.S. Pat. No. 4,658,690 issued to Aitken et al. entitled "Electronic Musical Instrument"), the combination of piano-like keys with a guitar-like synthesizer (U.S. Pat. No. 4,794,838 issued to James F. Corrigau, III entitled "Constantly Changing Polyphonic Pitch Controller"), electrically resistive elements in a guitar-like synthesizer with strings to detect sideways deflection of the string (U.S. Pat. No. 4,748,887 issued to Steven C. Marshall entitled "Electric Musical String Instruments and Frets Therefore") and infrared beams in a guitar controller for a music synthesizer where the infrared beams are reflected off a diaphragm in a breath controller (U.S. Pat. No. 4,580,479 issued to Carmine Bonanno entitled "Guitar Controller") or in a keyboard expression generator where the infrared beams are reflected off of keyboard members (U.S. Pat. No. 4,468,999 issued to Carmine Bonanno entitled "Programmable Synthesizer." With few exceptions, these devices to make or influence sound do not themselves have a plethora of integrated features such as the ability, in combination with producing musical notes and without limitation, to determine, influence or change the sound, quality, voice, volume or other characteristics of a note, activate and coordinate the replay of stored loops, record, edit and play user created pieces previously produced and control peripheral devices such as lighting all in a manner that is useful in a performance setting or in a manner that mimics or is compatible with the actions a musician takes to make or perform music and that simultaneously allows the user to add expressiveness to the notes that they are playing.

There are many examples of MIDI controllers that either adapt a conventional instrument or model the shape and performance of one. Generally, these controllers suffer in comparison to the original instrument in terms of expressiveness or have technical limitations. For example, guitar-to-MIDI converters must spend a finite amount of time in calculating the incoming note and this introduces a delay between the played note and the sound produced.

There is another category of MIDI controllers that are not bound to the model of existing instruments. This category can in turn be divided into two main classifications. The first are defined as devices that are used to influence the sound of notes that are generated independently. The second classification can be defined as devices that are used to generate the note tones. Sometimes these two functions are combined into one device but most commonly are separate.

The Midi interface standard allows for a great deal of flexibility in that messages from a keyboard can be used to control the playing of musical notes or can be used to control a variety of other functions. For example, a certain key on a musical instrument can be used to generate a musical note such as middle C, or can be "mapped" to instead trigger a pre-stored sequence of musical notes for accompaniment. This pre-stored sequence is often referred to as a loop since it is typically a short musical or percussion sequence that continuously loops.

There exist a number of software programs that are typically executed on personal computers that make it possible to manage this key mapping. In the example just given, the program will normally play the middle C note when the associated key is pressed, but this key can instead be assigned to trigger a loop that is under control of the program. This allows for a range of keys to be assigned to trigger background patterns while the unassigned keys play accompanying notes. The problem with this method is that whenever a key is assigned to a function other than note playing, that key is then unavailable for playing notes.

With just a few keys assigned to other functions, there is not a big problem since these keys can be at the extreme lower or upper range of a keyboard where notes are seldom played. However, it is often desirable to be able to trigger a wide range of loops, and this becomes impossible as the number of practically available keys is exceeded.

This proliferation of music in digital form along with the ubiquitous presence of personal computers has established the PC as a familiar way to manipulate music files. The majority of these PC applications are centered on organizing and downloading existing songs that are typically played back using portable devices such as Apple Computer's Ipod® devices. However, there is another category of PC software applications that are intended for the active creation or modification of digital music.

These programs make use of the power of modem computers to make it possible for those with limited musical knowledge to produce original music. This can be done through software programs that can "remix" existing songs in novel ways for "DJ" like settings.

There are other popular programs that enable a user to have more control over the generation of music in a very easy-tolearn fashion. Examples of this category include the Garage Band® program for use on Apple®™ computers. This concept of creating music on a PC also ties in with the growing popularity of "Podcasting" or "MySpace" sites in which an amateur musician has outlets for personally created, original music. The problem with these kinds of program is that a standard keyboard and mouse are used to control the creation and playback of the music, and even when used with an electronic keyboard, this presents a very non-musical interface that makes it difficult and non-intuitive for the process of music generation and control, especially for those with no prior musical experience. This is a problem in need of a solution.

There are musical devices that are an array of multiplexed switches. An example of such a device is shown in U.S. Pat. No. 5,557,057 entitled "Electronic Keyboard Instrument" issued to Harvey W. Starr on Sep. 17, 1996. This patent describes an electronic musical instrument that is generally guitar shaped (i.e, has a body and an extended neck). Instead of having strings strung along the neck like a guitar, the device has a fingerboard with an array of keys with a key at each position corresponding to each string/fret position in a traditional guitar. When the user touches a key, a signal is produced and sent to a central processing unit that produces an appropriate sound that is then sent to an output.

Although this device has an array of keys and a series of key, push buttons, pads and switches, it still requires the user to manipulate the device in a fashion very similar to manipulating a guitar (i.e., one hand grasping the neck and playing notes off of the neck while the other hand manipulates the keys, push buttons, pads and switches on the body of the instrument).

In view of the foregoing, there is a need for devices that generate digital commands that in turn are interpreted by something else to generate a sound with specific parameters or control musical expression or other control functions that are useful in a performance setting or generate note tones itself that mimics or is compatible with the actions a musician takes to make or perform music and that allows the user to add expressiveness to the notes that they are playing.

SUMMARY OF THE INVENTION

The present invention is a musical device that generates digital information that is in turn used to generate note tones. It can also, influence the sound of notes that are generated independently and performs a variety of user defined or user controlled activities. These activities include but are not limited to producing musical notes, determining, influencing or changing the sound, quality, voice, volume or other characteristics of a note, activating and coordinating the replay of stored loops, recording, editing and playing user created pieces previously produced and controlling peripheral devices such as lighting. The musical device uses a combination of strings and frets to locate notes on a fingerboard that a user may activate. It also includes an array of infrared sensors that is used in conjunction with the strings and frets to both provide confirmation of finger placement and approach so as to provide the expressivity that would otherwise be missing from a simple mechanical array of switches. Expressivity or expressiveness in this context refers to modulation or other effects applied to the pure tone or to the voices generated by a musical instrument and may include, for example and without limitation, volume, a tremolo or the like which is superimposed upon the output.

The notes correspond to locations on the fingerboard. As a result, the invention includes a system to generate digital messages that are used to create a sound corresponding to a note selected and activated according to preselected parameters such 15 as the voice (e.g., trumpet, violin). A user's intent to play a particular note is preferably confirmed by a system of sensors corresponding to each note position that confirms a user's intent to play a particular note. The musical device also includes one or more switches that activate functions, loops or voices corresponding to note positions on the fingerboard.

In one preferred embodiment, the music device is a stand alone unit. In another preferred embodiment, the music device is a computer peripheral that is attached to a standard PC or laptop computer. In this embodiment, the music device may be a relatively low-cost peripheral for existing computers and software applications. In another preferred embodiment, the music device may be a peripheral for popular stand-alone game platforms such as the Microsoft X-Box® and Sony Playstation® video game systems. In addition, in either embodiment the music device allows anyone who has a desire to playa musical instrument, but does not have the prodigious amount of time that is required to master a conventional musical instrument, to produce relatively high quality music. Also, in either embodiment, the music device allows skilled musicians to expressively and easily perform their desired music.

In a preferred embodiment, the invention uses a MIDI interface to interact with other devices. Because of its MIDI standard interface, the present invention can interface directly with devices and programs that create sounds and music, teach music or otherwise allow users to express their musical creativity and devices such as the portable devices and podcasting systems mentioned above. The present invention allows a user to control these programs and devices through a natural musical interface that consists of strings and frets. This interface is similar to a guitar except that only one hand is needed to generate a sound; pressing a string between the frets generates a MIDI command. As mentioned above, an array of infrared sensors senses the position of the user's fingertips as music is produced on the invention to provide a means to capture musical expression. This capture of expression is essential in providing a musical experience that is acceptable to advanced musicians.

The technology of the present invention can be used in a conventional guitar-like format. However, because of the presence of the array of infrared sensors, the present invention uses the array of infrared sensors to capture subtle nuances of the musical performance while the fret/string combination provides tactile feedback and an intuitive interface with the musical device. The array of infrared sensors acts as a non-contact sensing device that provides information about the fingers approach to the note prior to its activation. This can be used for "velocity sensing" that is a standard MIDI parameter to control the volume of the note produced.

In addition, the infrared sensor array provides ongoing information about the user's finger position after the note is activated. This allows for rapid modulation of the note after it is pressed by moving the finger back and forth between the frets. It also can provide a function called "aftertouch" that provides information about how the note is released. In addition, the fact that this array is an array of solid-state infrared sensors means that it is far less costly, easier to produce and more reliable than an array of mechanical switches.

In any of these embodiments, the music device is capable of having a large feature set. However, despite having the ability to have a large feature set, the music device also is accessible and easy to use on a number of different levels so that the end user can immediately begin using it in an entertaining way. But, the device is also sophisticated enough to allow for continual advancement as the expertise of the user grows.

The musical device described herein takes the ease and accessibility of piano keys but retains the ability to move patterns and scales as on a guitar. In addition, having multiple strings provides a dimension that the piano lacks. Instead of having to cover an entire range of notes horizontally, the musical device adds the back-and-forth vertical dimension and so allows for a much greater range of notes in a compact size.

The present musical device integrates an easy-to-play yet powerful musical instrument with a wide variety of easily accessible controls to manipulate the playback of both live and prerecorded music.

There are many objects of the present invention that may be addressed individually or in combinations and permutations in the various embodiments of the invention. Consequently, a particular embodiment of the invention may address one or more of the following objectives.

It is therefore an object of one or more embodiments of the invention to provide a novel musical device.

It is an object of one or more embodiments of the invention to provide a musical device having one or more of the following features:

the combination of the ease and accessibility of piano keys with the ability to move patterns and scales as on a guitar;

the presentation of an entire range of notes horizontally and vertically;

a compact size;

a large feature set;

a robust musical device that plays only the notes intended by the user to be played;

a musical device that is relatively easy for a beginner to play;

a musical device that is sophisticated enough to allow detailed and complex musical expression by an experienced and sophisticated user.

These and other objects and advantages of the invention will be clear in view of the following description to the invention including the associated drawings.

BRIEF DESCRIPTION OF THE DRAWINGS

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

DETAILED DESCRIPTION OF THE PREFERRED EMBODIMENT

Figure 1:
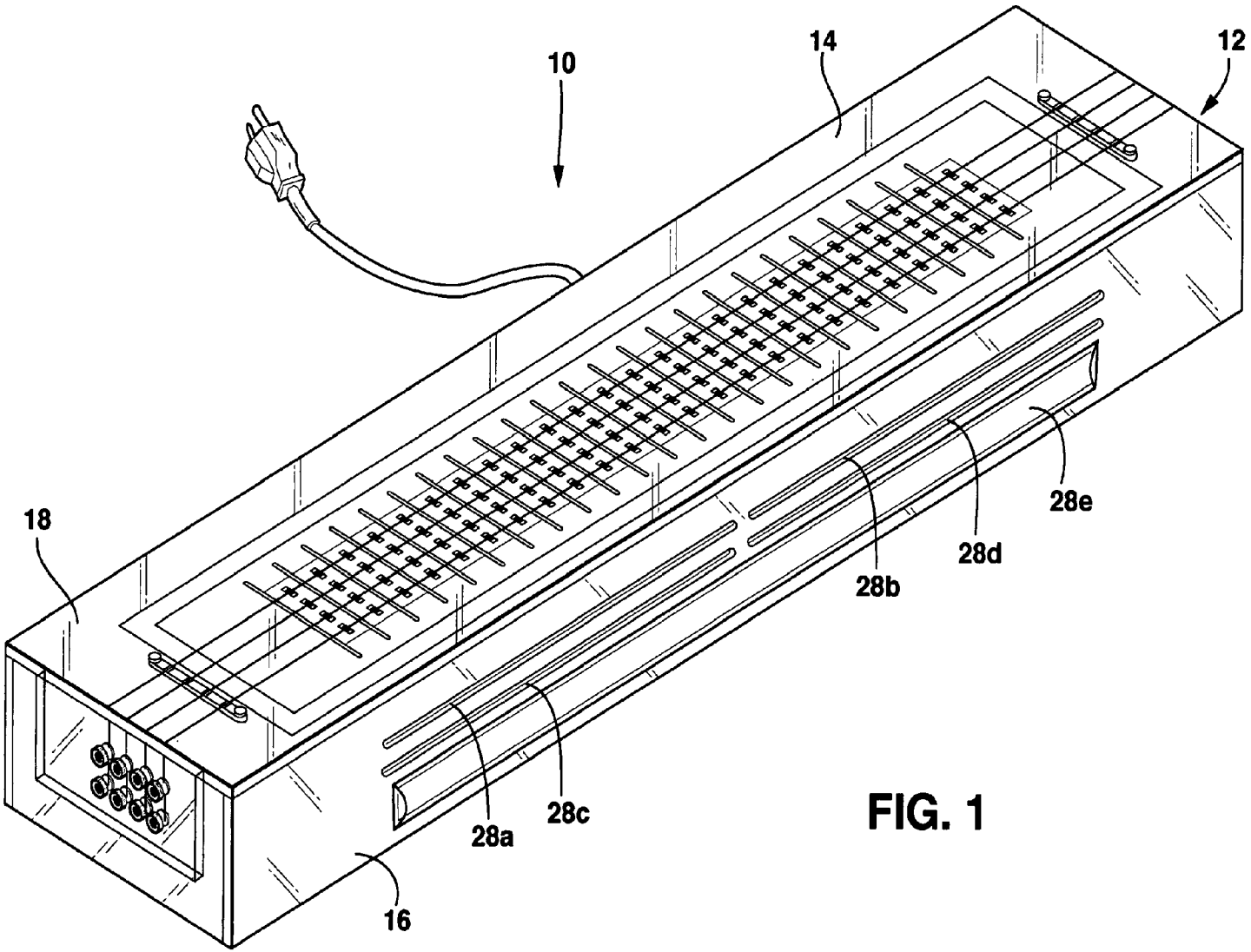
FIG. 1 is a perspective view of an embodiment of this invention.
Figure 2:
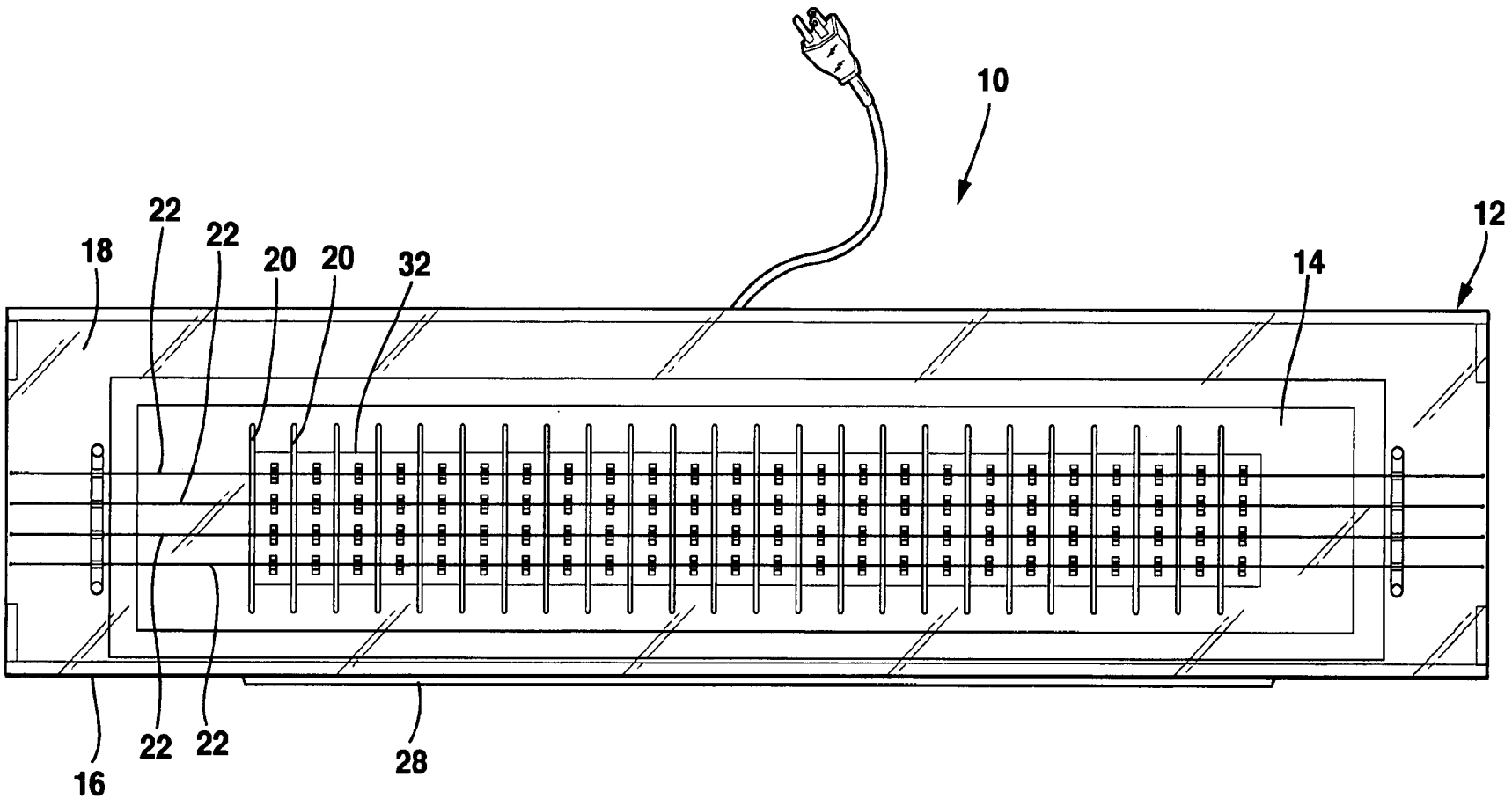
FIG. 2 is a top view of the invention of FIG. 1.
Figure 3:
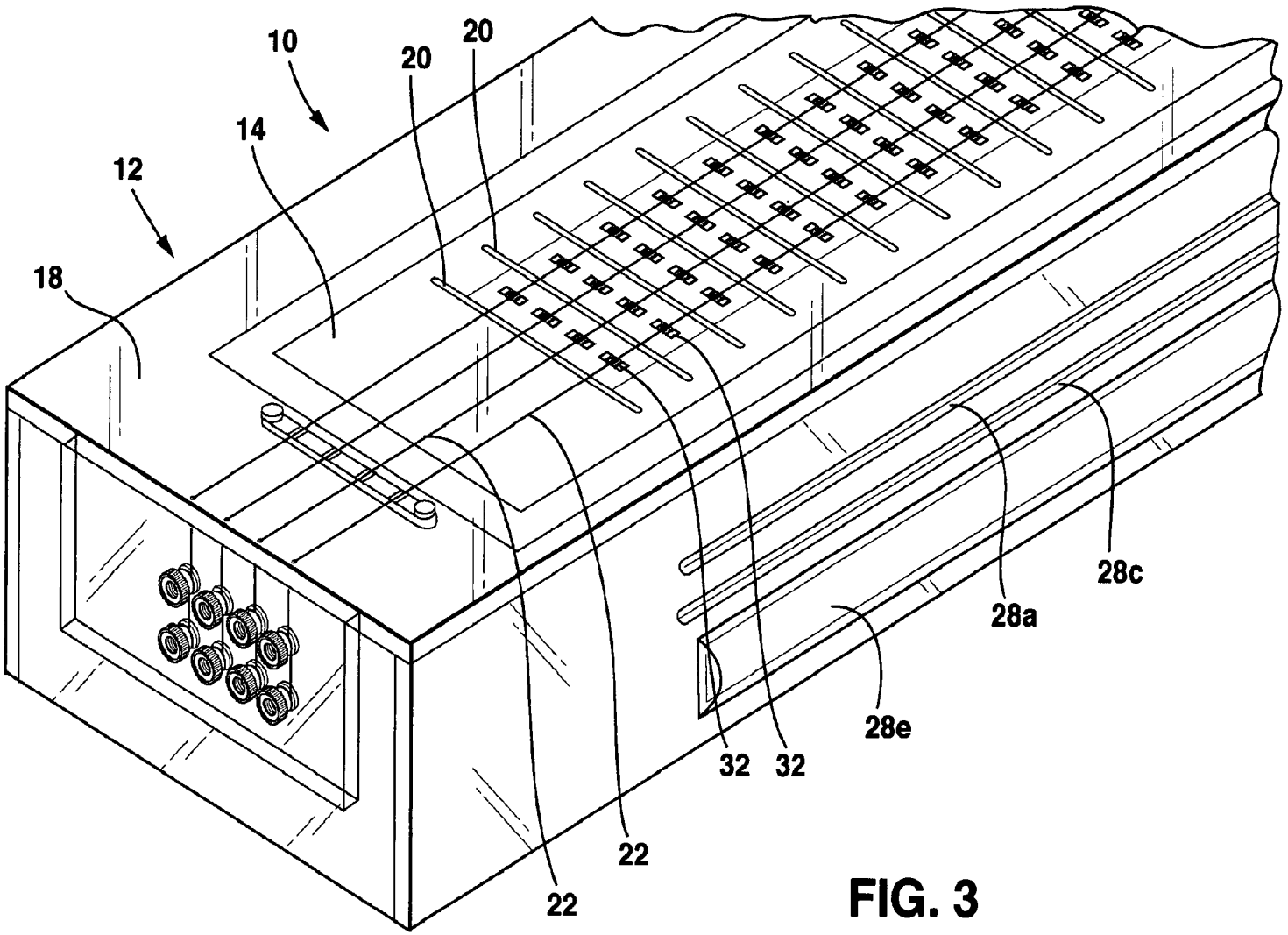
FIG. 3 is an end view of one end of the invention of FIG. 1.
Figure 4:
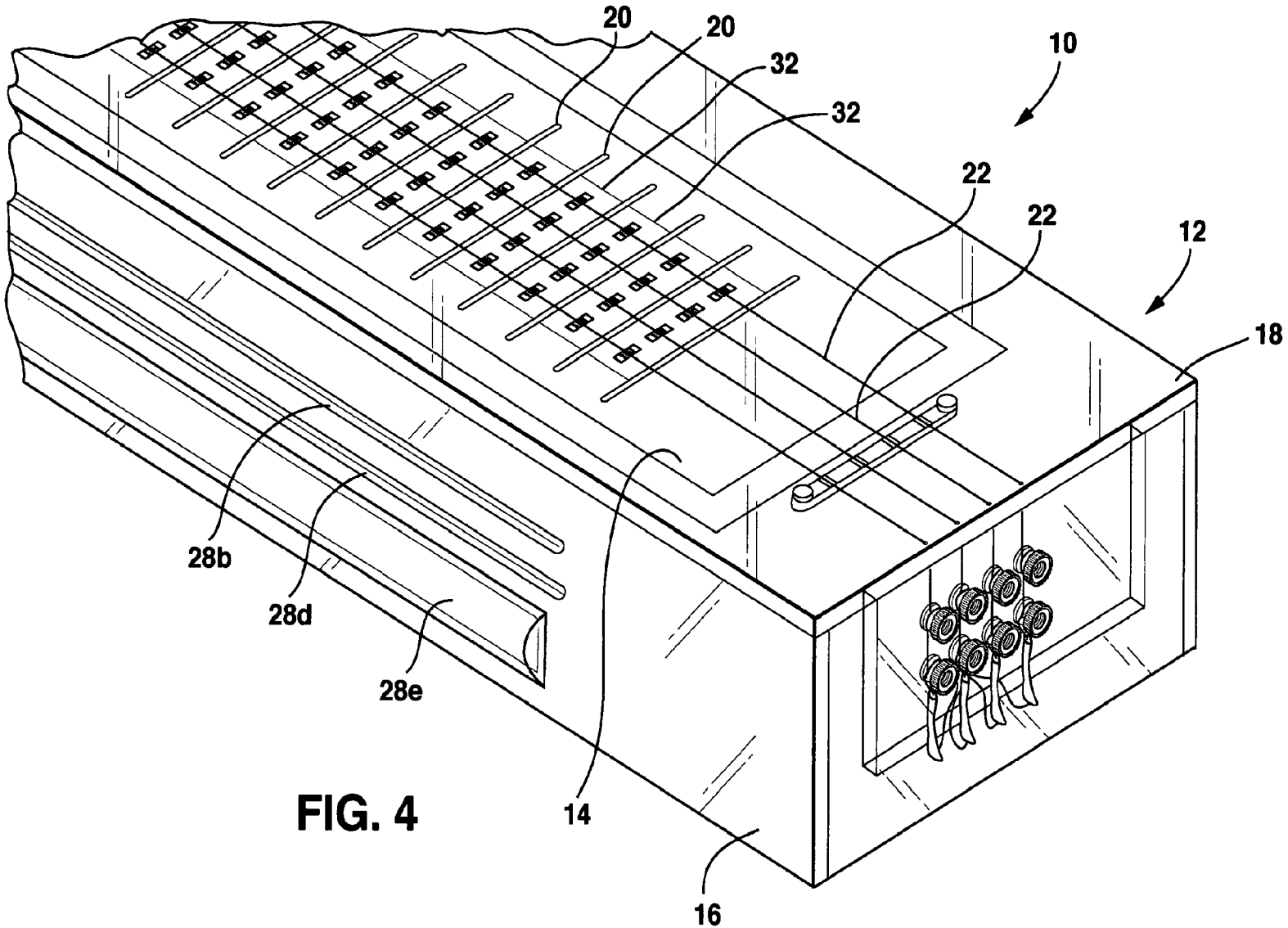
FIG. 4 is an end view of another end of the invention of FIG. 1.
Figure 5:
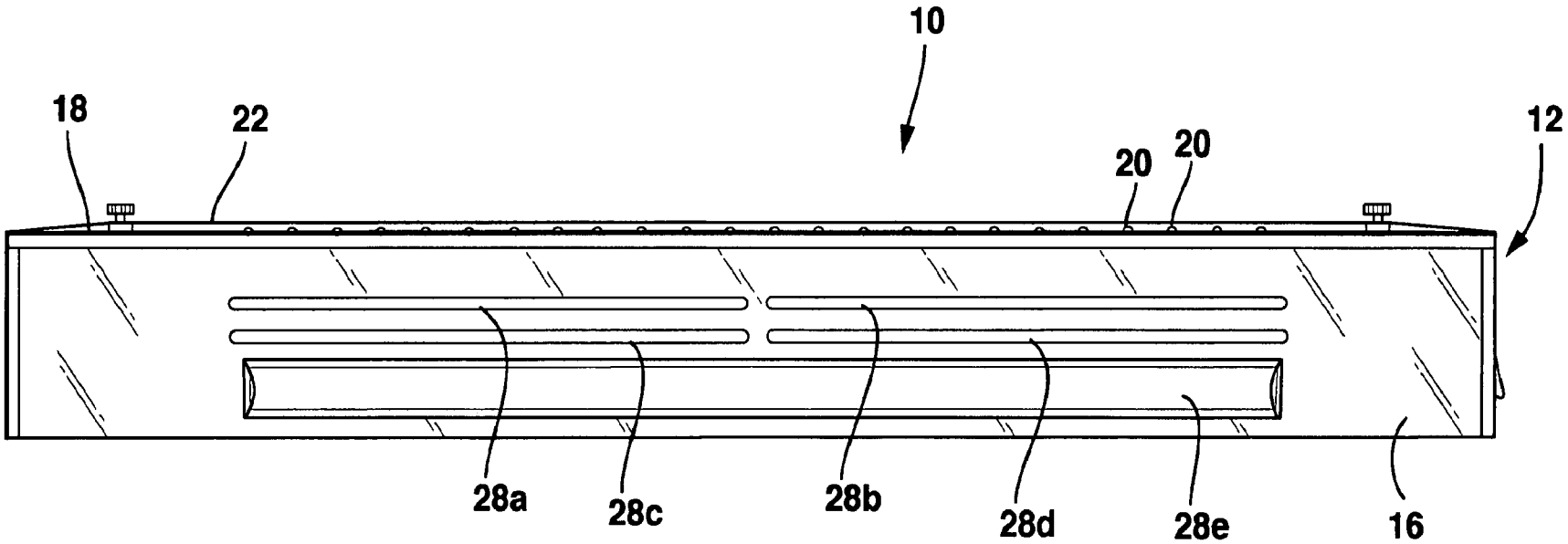
FIG. 5 is a front view of the invention of FIG. 1.
Figure 6:
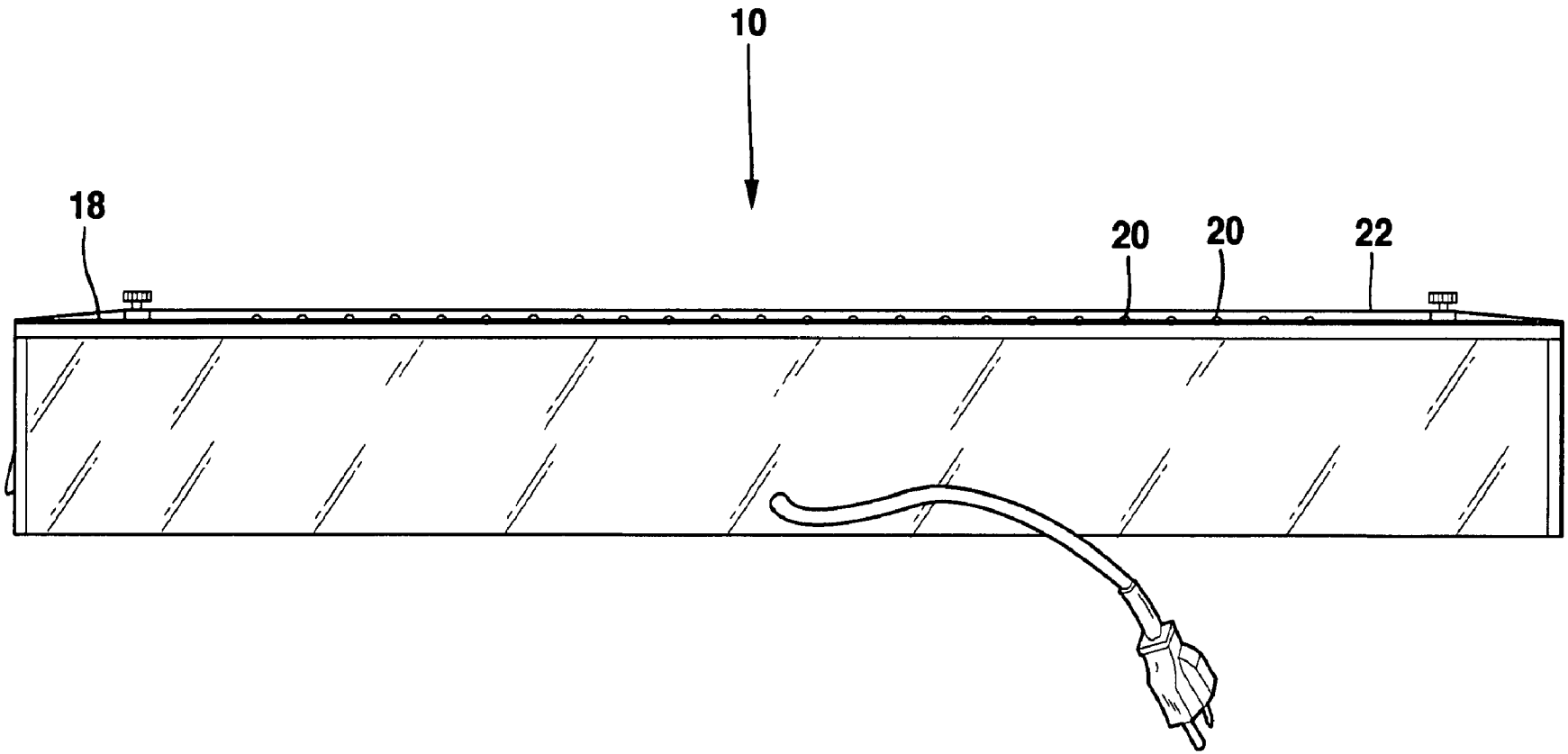
FIG. 6 is a back view of the invention of FIG. 1.

The musical device of the present invention is shown in FIGS. 1-17 generally labeled 10. The musical device 10, in the preferred embodiment shown in FIGS. 1-7, has a main body 12 with a fingerboard 14. The main body 12 has a front 16 and a top 18. The fingerboard 14 is located on top 18 of the main body 12.

The fingerboard 14 resembles a conventional fret board on a guitar that has been placed on its back. Consequently the fingerboard 14 has a series of frets 20 equally spaced along the fingerboard 14 with the same spacing that is used on conventional computer keyboards. This equal spacing is in contradistinction to the spacing of frets on guitars whose frets are spaced with progressively smaller intervals with higher pitches. The function of the frets 20 is both to provide feedback as to the note position on the fingerboard 14 and to make an electrical contact with strings 22 as will be described hereafter. The frets 20 are preferably spaced from each other in a parallel configuration. In the preferred embodiment of the musical device 10, there are 25 frets 20 producing 24 fret pairs (i.e., frets 1 & 2, frets 2 & 3 . . . frets 31 & 32 and frets 32 & 33). Although the preferred embodiment of the musical device has 25 frets 20, the musical device could have fewer or more than 25 frets 20.

The fingerboard 14 has a series of metal strings 22 that are installed across the length of the fingerboard 14 at right angles to the frets 20. In the preferred embodiment of the musical device 10, there are four strings 22 although there could be fewer or greater than four strings 22. These strings 22 are tensioned and positioned a short distance above the metal frets 20. The function of the strings 22 is to help the user locate a note on the fingerboard 14, provide tactile feedback to the user and to make electrical contact with the frets 20.

Figure 9:
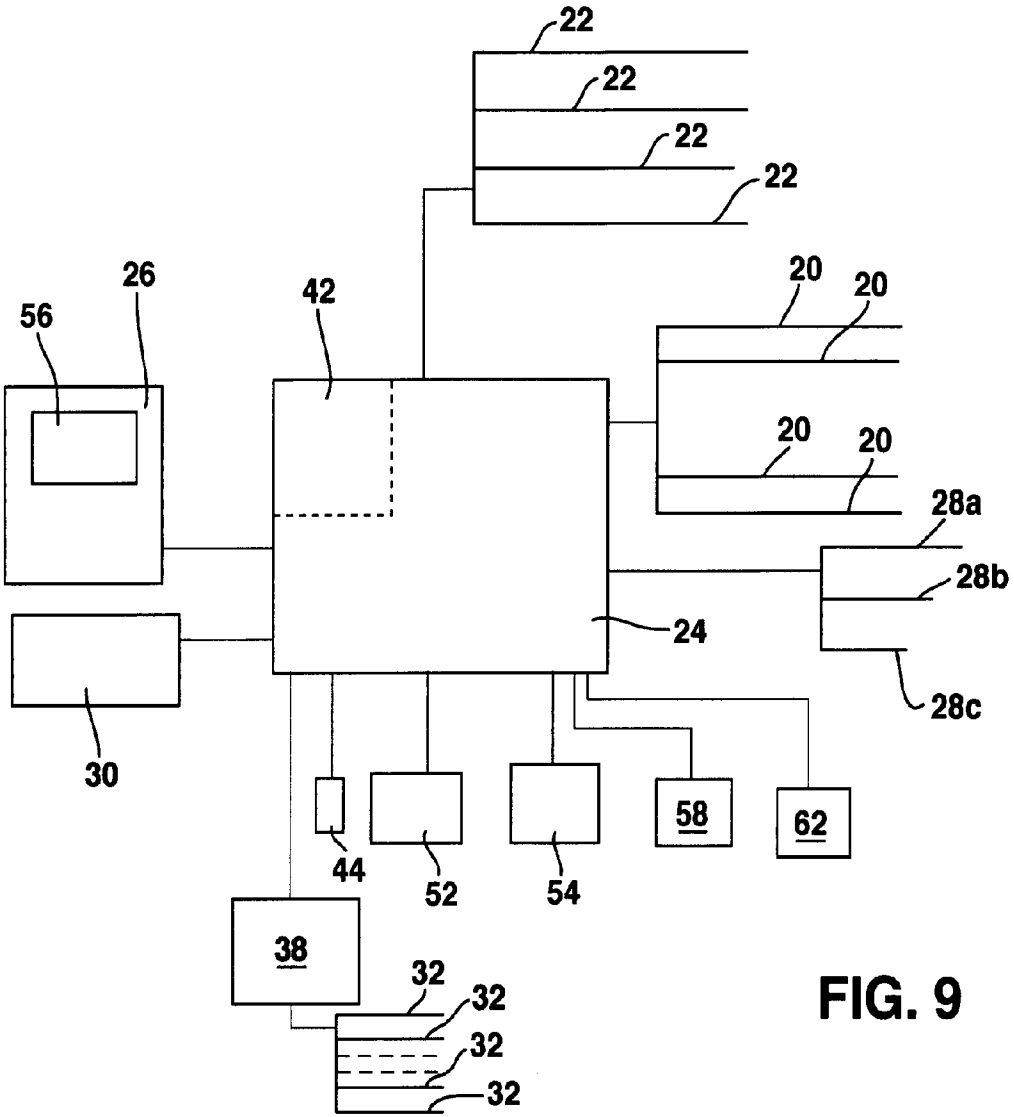
FIG. 9 is a schematic view of the electronics of the invention of FIG. 1.

Each of the frets 20 and the strings 22 are electrically connected to a microprocessor 24 (FIG. 9). Microprocessor 24, through software programming, directs the note identification process as will be described hereafter, generates sounds in response to the user's playing of notes and in accordance with the user's selection of functions and voices, stores and plays loops and controls the LED arrays and displays that aid the user in identifying and playing functions, loops and voices. Microprocessor 24 is preferably an integral part of the musical device 10. But, in an alternate embodiment, microprocessor 24 may also be the microprocessor of a computer 26, such as a laptop computer, that is connected to the musical device 10. In the preferred embodiment of the invention, the musical device 10 operates using the MIDI interface standard although other interfaces as will occur to those skilled in the art that allow the musical device 10 to interact with other devices may be used as well. The MIDI interface standard allows for a great deal of flexibility in that messages from the fingerboard 14 and a bar 28 or bars 28, as will be described hereafter, to control the playing of musical notes or can be used to control a variety of other functions, loops or voices, also as will be described hereafter. For example, a certain key on the fingerboard 14 can be used to generate a musical note such as middle C, or can be "mapped" to instead trigger a pre-stored sequence of musical notes (e.g., loops) for accompaniment.

In the preferred embodiment of the musical device 10, a software program similar to the programs commercially available for managing MIDI interfaces is executed on an external processor such as that in a personal computer 26. The microprocessor 24 inside the music device 10 manages the note detection and generation of MIDI note commands The program will normally play the middle C note when the associated key is pressed. But, when a bar 28 is depressed as described hereafter, the microprocessor 24 generates a different note command that is communicated via the MIDI interface to an external device and that can be e assigned by the external software programs to trigger a function, loop or voice that is under control of the program. This allows for a range of keys to not only be available to play musical notes, but also to be assigned to trigger background patterns, functions or voices. Of course, in an embodiment where the musical device 10 contains both the microprocessor 24 or similar circuitry and a microprocessor or similar circuitry for running programs or otherwise generating musical notes in response to the user's interaction with the fingerboard 14 as determined and communicated by the microprocessor 24, the functions of interacting with the fingerboard 14 and producing corresponding notes or running corresponding activities would all be accomplished in a single musical device 10.

The musical device 10 is normally played with the fingerboard 14 face up with the user facing the musical device 10. The musical device 10 can be played with both hands as with a piano. Notes are played by tapping lightly on the string 22 in the space between the frets 20. In the preferred embodiment, as will be explained hereafter, the musical device 10 is sensitive to the velocity of how the fret 20 was tapped for expanded expression.

Figure 10:
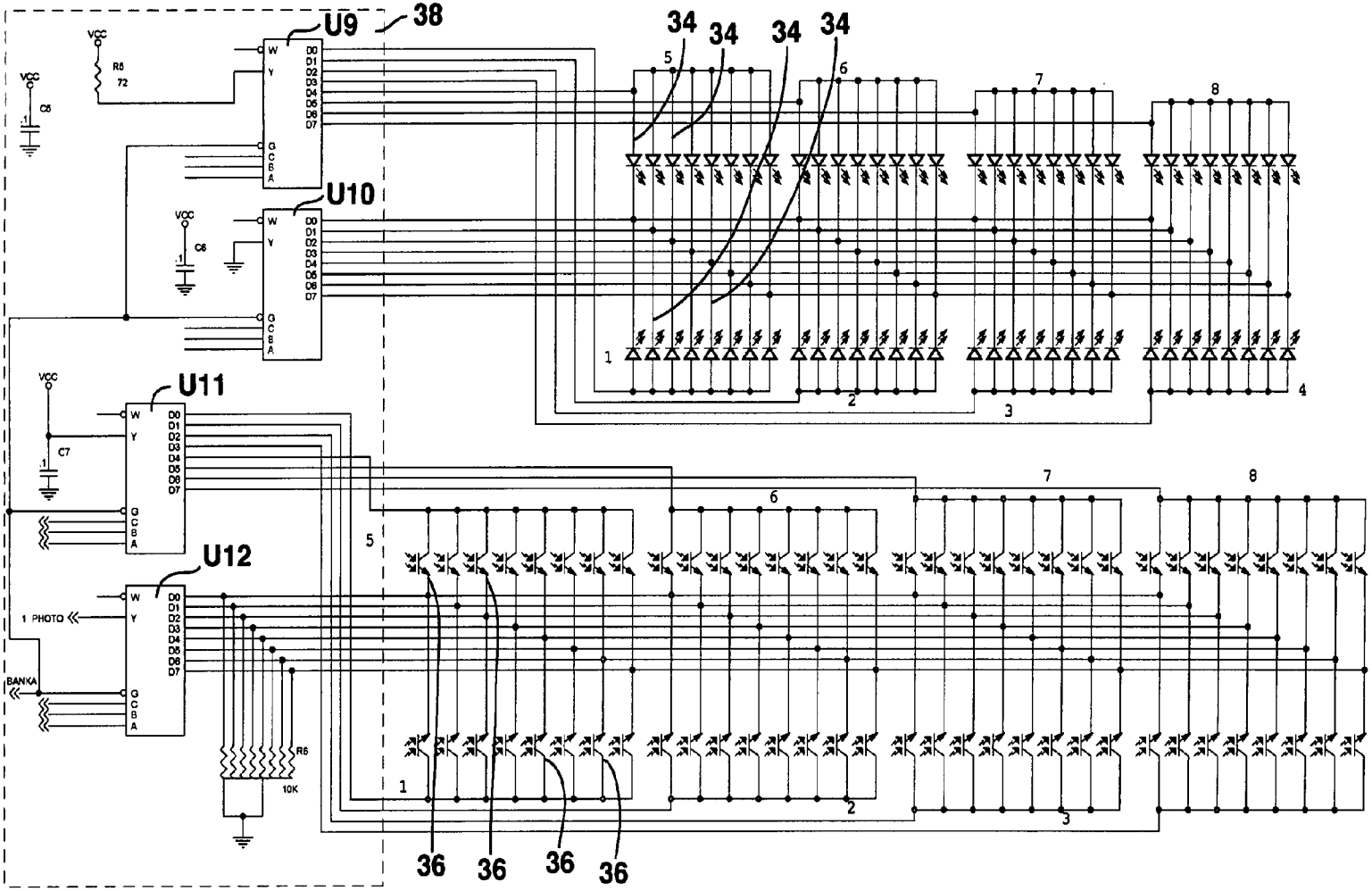
FIG. 10 is a schematic view of the multiplex circuit of the invention of FIG. 1.
Figure 11:
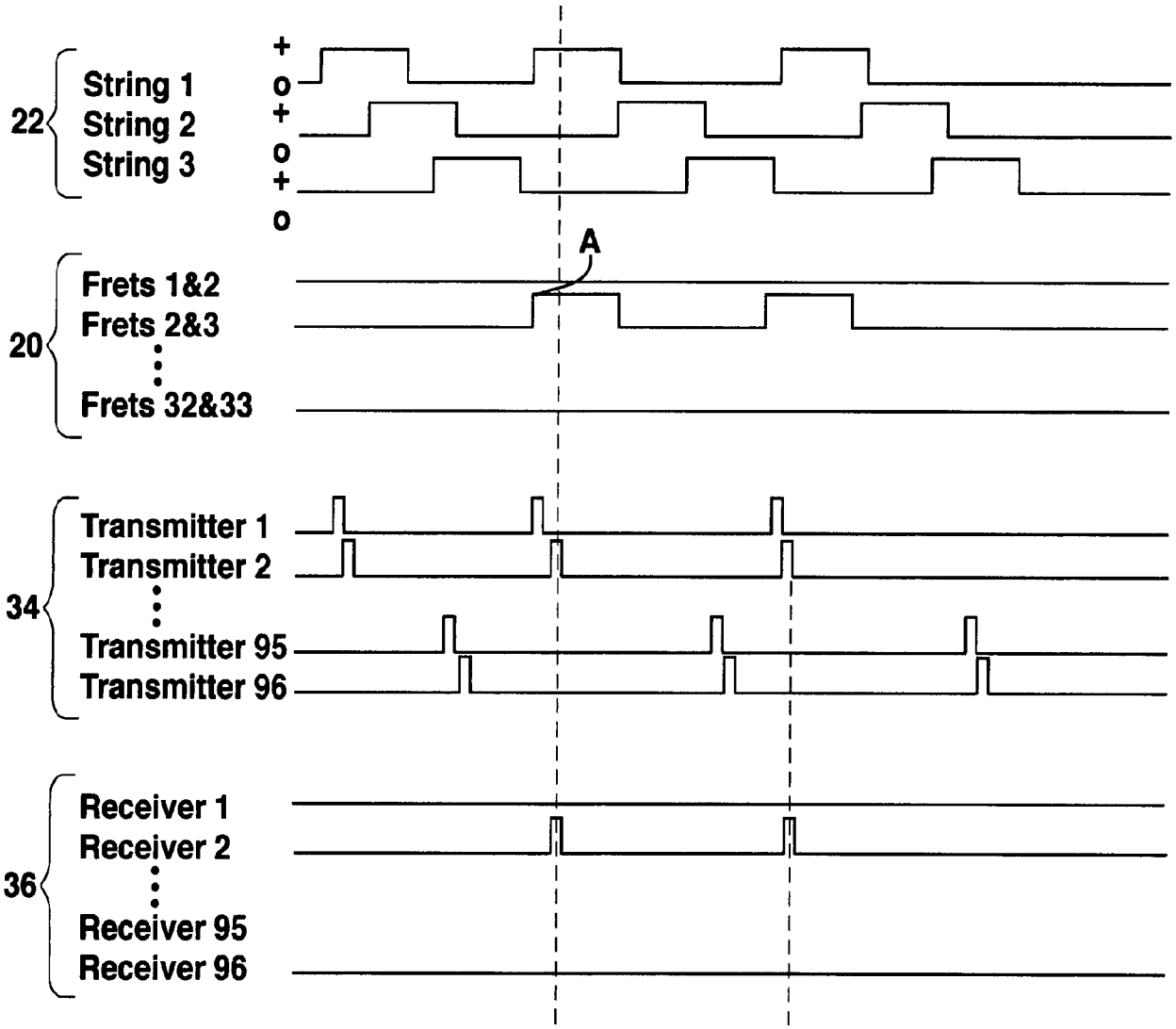
FIG. 11 is a timing chart showing the interaction and timing of the various elements of the present invention to detect and confirm that the user has selected a particular note.

Pressing on the string 22 between two frets 20 will make electrical contact between the two frets 20. As shown in FIGS. 10 and 11, this contact is sensed in a multiplexed fashion by the microprocessor 24 that sends a "high" logic level signal on each string 22 in sequence and then scans the array of frets 20. If this logic "high" level is detected on two sequential frets 20 ("A" in FIG. 11), this indicates contact between a string 22 and a pair of frets 20. As a result, the location of the "note" played by the user is established. This method is fairly simple and is really an array of multiplexed switches. The microprocessor 24 then produces an output signal based on the "note" detected and presents this output signal to an appropriate output device 30 such as internal or external speakers or a computer 26.

Although the preferred embodiment of the invention includes electrically connecting the frets 20 and strings 22 to a microprocessor 24, other embodiments of the invention include electrically connecting the frets 20 and strings 22 to discrete analog or digital circuitry or a combination of discrete analog or digital circuitry with a microprocessor 24 to produce the logic level signals on each string 22 and scan the array of frets 20 to determine contact between the frets 20 and strings 22. Further, discrete analog or digital circuitry or a combination of discrete analog or digital circuitry with a microprocessor 24 may be used to produce the desired "note" in response to a detected electrical connection between the frets 20 and strings 22.

Although the present invention includes a fingerboard 14 having just frets 20 and strings 22 coupled to a microprocessor 24 as described above and is an embodiment of the invention, this embodiment of the invention having a fingerboard 14 with just frets 20 and strings 22 is not the preferred embodiment. This embodiment has several drawbacks. One is that the mechanical alignment is critical in that any small difference in height among the frets 20 will result in false contact closures. A second problem arises when there are multiple contact closures on the same string 22 as would happen if a string 22 is pressed between two frets 20 and the same string 22 is pressed two positions to the right or left of these two frets 20. In this case there will be a contact closure across three positions and it will be impossible to distinguish which two of the three notes are the intended ones to be played. A third problem is that it is desirable to include information that relates to the volume of the note to be played (called velocity in MIDI), and this is not provided in the simple contact sensing arrangement described above.

Figure 7:
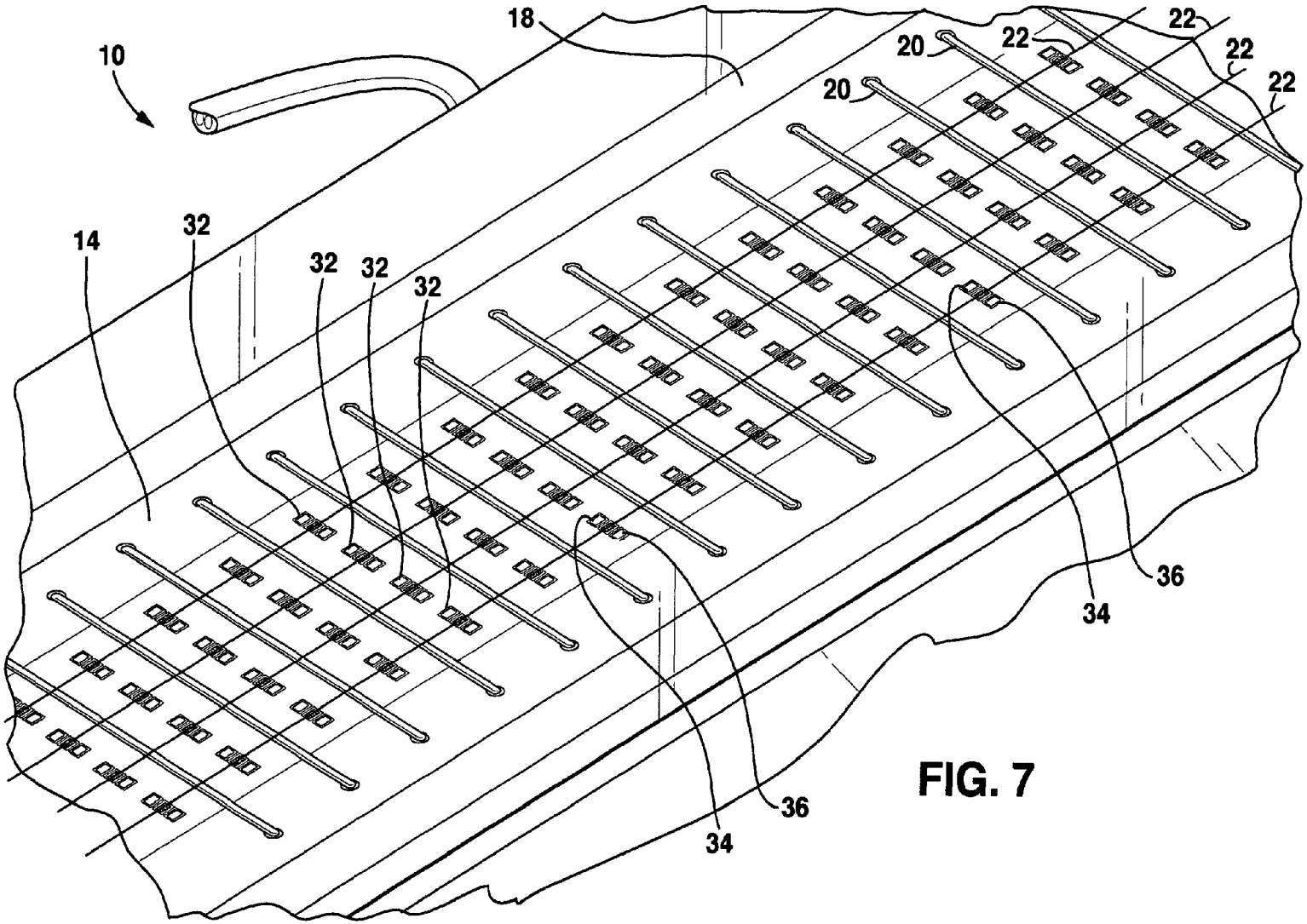
FIG. 7 is a close up view of the IR LED system of the present invention.
Figure 8:
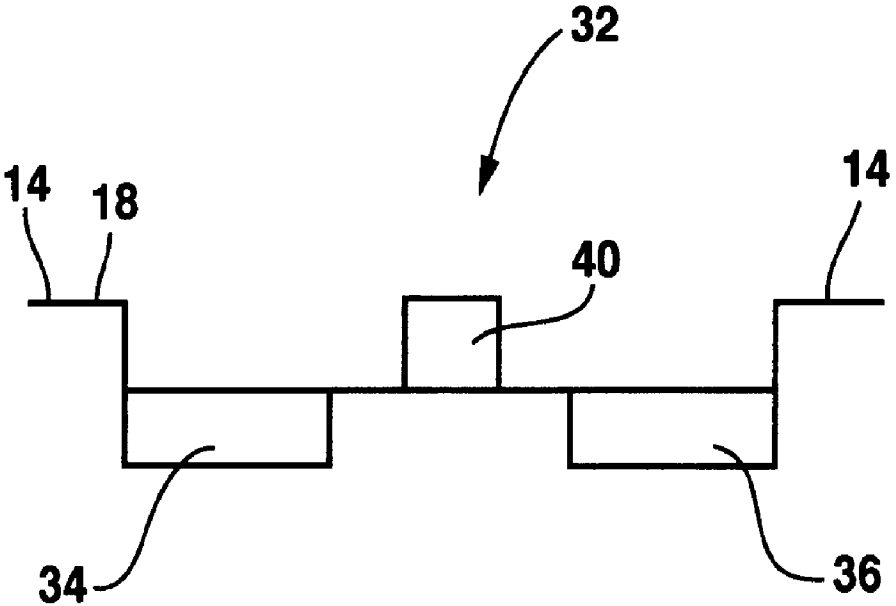
FIG. 8 is a schematic side view of the IR LED system of FIG. 7.

To solve these problems, an array of infrared sensors 32 is employed (FIGS. 7 and 8). As shown schematically in FIG. 8, the sensors 32 are installed on the face or top 18 of the fingerboard 14. A sensor 32 is installed at each note position (i.e., each position corresponding to the intersection of a string 22 and the space between adjacent frets 20).

Each sensor 32 includes a IR LED transmitter 34 that transmits IR light from the transmitter 34 and a corresponding receiver 36 capable of receiving the IR light transmitted from the transmitter 34. Receiver 36 is preferably a photodiode but may be any device that, upon receipt of IR light, completes or actives a circuit. Each transmitter 34 is located on the face of the fingerboard 14 so that the IR light is transmitted from the transmitter 34 essentially perpendicular to the face of the fingerboard 14 (i.e., at a 90-degree angle along with some amount of beam spread). Each receiver 36 corresponding to a particular transmitter 34 is located next to its partner transmitter 34 and is also directed essentially perpendicular to the face of the fingerboard 14.

In this configuration, normally little or no IR light transmitted by a transmitter 34 is detected by its corresponding receiver 36. When a finger is placed in close proximity to the sensor 32, some of the IR light transmitted by transmitter 34 is reflected off of the finger and the receiver 36 detects some of this reflected light. The microprocessor 24 sequentially activates each transmitter 34 and simultaneously checks each corresponding receiver 36 to see if the receiver 36 is detecting light transmitted by transmitter 34 and reflected off of the user's finger (FIGS. 10 and 11). This detection indicates the presence of the user's finger and is then used in conjunction with the contact closure between the frets 20 and strings 22 previously described to provide confirmation that the finger position and consequently a desired note is sensed properly. In particular, if microprocessor 24 detects that a particular note has been selected by the user to be played by sensing a contact between a string 22 and a pair or adjacent frets 20, the detection of a signal by receiver 36 at that same note location confirms that the detected note is in fact the note that the user intends to be played. This confirmation of note eliminates the ambiguity in note position described above that might occur if the string 22 were inadvertently to contact a fret 20 on either side of a pair of frets 20 corresponding to the note the user actually intended to play as described above.

This array of sensors 32 is arranged in banks (1-8 in FIG. 10—this schematic shows a total of 64 sensors 32 but in a preferred embodiment, there are 96 although the invention could be practiced on more or less banks). Each of the sensors 32 is connected to a multiplex circuit 38 as shown in FIG. 10. One embodiment of the multiplex circuit, as shown in FIG. 10, contains discrete electronic elements. U9 is an analog multiplexor IC that provides power to one of the 8 banks of LEDs transmitters 34, while U10 selects which LED transmitter 34 within the bank will have a path to ground. Where there are 96 notes, when a digital address from 0-95 is applied to the two ICs, one of the 96 IR transmitters 34 will be turned on. In a similar fashion, discrete electronic elements U11 and U12 select the output of one of the 96 IR receivers 36. Each receiver 36 has a corresponding transmitter 34 located adjacent to it so that these are both selected simultaneously via the analog multiplex circuit 38. This multiplex circuit 38 and method offers several advantages in that a higher current can be provided to the LED transmitters 34 than a static method could provide, resulting in greater sensitivity to finger sensing. Also, total power consumption is greatly reduced since only one of the arrays is active at any one time. This reduces the overall system cost.

The preferred embodiment of the invention includes sensors 32 as described above. However, it may be desirable to place a light barrier 40 between each transmitter 34 and its corresponding receiver 36 to block any stray light from the transmitter 34 from contacting its corresponding receiver 36 and inadvertently be detected and interpreted as being the user attempting to activate the note corresponding to that position. FIG. 8 illustrates such a light barrier 40 as a low wall between a transmitter 34 and its corresponding receiver 36 to physically block stray light from the transmitter 34 from contacting the corresponding receiver 36. In the preferred embodiment, the light barrier 40 is a LED in the LED array 58 as will be described hereafter.

The IR LED sensors 32 alone are inadequate for detecting the user selecting specific note selections in musical applications because it is impractical to calibrate the IR thresholds to be uniform across the array of sensors 32 and tactile feedback is very important in a musical instruments. However, the combination of sensors 32 with the electronic configuration of frets 20, strings 22 and microprocessor 24 described above produces a musical device 10 that is robust in accurately determining that a particular note has been selected by the user to be played.

In the example shown in FIG. 11, a user is playing a note located on the first string 22 and between the $2^{nd}$ and $3^{rd}$ frets 20. As can be seen, as the microprocessor 24 sends a "high" logic signal to this first string 22, as the user contacts the string 22 and moves it into electrical contact with the 2nd and 3rd frets 20, this "high" logic signal is communicated to the $2^{nd}$ and $3^{rd}$ frets 20 and sensed by the microprocessor 24. This electrical contact will produce a closed current loop from the first string 22 to the $2^{nd}$ and $3^{rd}$ frets 20 so long as the user's finger maintains the string 22 in contact with the $2^{nd}$ and $3^{rd}$ fret 20 and so long as the "high" logic signal is sent to the first string 22. But, because the microprocessor 24 cycles the "high" logic signal from one string 22 to the next string 22, periodically the "high" logic signal will appear on the $2^{nd}$ and $3^{rd}$ frets 20 at the same time as the "high" logic signal is sent to the first string 22. Circuitry or digital signal processing will consequently identify that a note is being played at the location of the intersection of the first string 22 and the space between 2nd and 3rd frets 20 when a "high" logic signal is detected on the 2nd and 3rd frets 20 at the same time as the "high" logic signal is sent to the first string 22.

That this note is being played is confirmed by the multiplex circuit 38 and microprocessor 24. This is accomplished, as shown in the example of FIGS. 10 and 11, by the microprocessor 24 directing the multiplex circuit 38 to sequentially active each transmitter 34 and simultaneously check to see if the light produced by the transmitter 34 is being detected by its receiver 36 pair. In the example shown and described above, the transmitter 34 corresponding to the note located on the first string 22 and between the 2nd and 3rd frets 20 will eventually be activated as the microprocessor 24 directs the multiplex circuit 38 to cycle through the transmitters 34. Because the user's finger is holding the string 22 in contact with the $2^{nd}$ and $3^{rd}$ frets 20, light from this transmitter 34 will be reflected off of the user's finger and be detected by the receiver 36 corresponding to this transmitter 34. Once again, circuitry or digital signal processing will associate this simultaneous transmission of light by transmitter 34 and its corresponding receipt by its pair receiver 36 as confirmation that the user's finger is indeed located at this location.

In addition, the IR sensors 32 allow for additional expressivity parameters such as note velocity. Note velocity can be used to indicate the loudness of the note being produced as takes place when a piano note is struck or a guitar string plucked. Note velocity can also be used to control other MIDI parameters other than the loudness of the note such as a preset or user determined filter setting that changes the characteristic sounds of the note.

This detection of note velocity is accomplished by starting a timer, preferably an electronic timer 42 on microprocessor 24, when an initial threshold is sensed by the receiver 36 (i.e., IR light above a certain threshold is detected by the receiver 36) and ending the timer at a higher threshold (i.e., a higher level of IR light is detected). The difference in thresholds of IR light detected by the receiver 36 corresponds to an increase of reflected IR light received by the receiver 36 as the user's finger approaches the sensor 32 to hit the string 22 and reflects IR light from the transmitter 34 to its corresponding receiver 36. The time between these two threshold events is proportional to the speed of the finger that hits the string 22 and so velocity information can be sent to and determined by the microprocessor 24 when the playing of a particular note is detected and transmitted. With the time between these two thresholds, the microprocessor 24 can make the determination of the speed of the finger by direct calculation or by looking up the speed in a lookup table.

In a sense, the musical device 10 combines some of the best aspects of a piano and guitar without the difficulty associated with learning to play these instruments. A piano, unlike a guitar, has a logical and accessible layout of a piano keyboard that can be played with both hands. Learning a guitar requires twisting the left hand in awkward positions while hitting notes with the right hand. So, in this regard, a piano is more accessible.

However, an advantage of a guitar is that once a scale or pattern of notes is learned in one position (i.e., a chord), it is easy to convert into any other key by simply moving the position up or down by a number of frets—the musical pattern stays the same. The same situation on a piano requires memorizing a different pattern or scale for every key owing to the layout of the black and white keys.

The musical device 10 of the present invention combines the ease and accessibility of piano keys with the ability to move patterns and scales as in a guitar. In addition, having multiple strings 22 provides a dimension that the piano lacks. Instead of having to cover an entire range of notes horizontally, the musical device 10 adds an up and down vertical dimension that allows for a much greater range of notes to be located in a compact size.

Another element of expression that is important on a guitar but missing from a piano is the ability to "bend" notes by stretching the guitar string while being played (an important element in guitar styles such as blues guitar or certain types of rock music). The ability to "bend" a note by altering pitch is a feature that is commonly installed on electronic keyboards and is actuated by a device called a pitchbend wheel. Moving the pitchbend wheel either up or down produces an effect of raising or lowering the pitch of the notes in a way that sounds like the change in pitch produced by "bending" (stretching) a guitar string. However, using this pitchbend control requires the user to remove one hand from the keyboard to activate the pitchbend control making the user's ability to play notes with this hand temporarily interrupted.

This ability to "bend" notes is included on the musical device 10, with the additional feature that the note can be bent either up or down or can even be assigned to control another parameter such as volume or alteration of the tone through electronic filters. The pitch bending method on the musical device 10 allows for easily adding this expression while in the course of playing notes without requiring the user to interrupt note playing with one hand to "bend" the note. This provides a great deal of additional expressivity as compared to a piano or keyboard.

Figure 14:
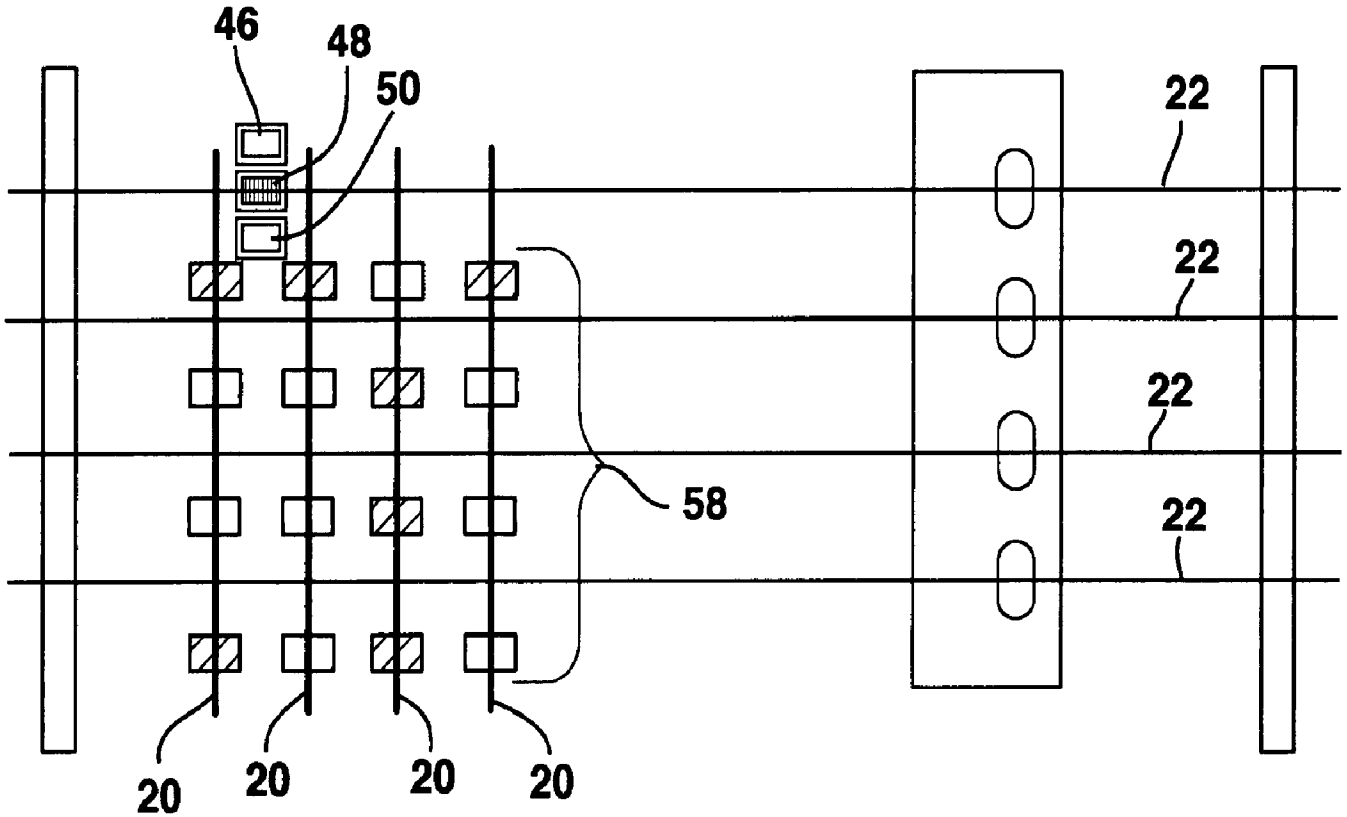
FIG. 14 is a close up perspective view of an embodiment of the present invention showing an array of LEDs identifying under which notes a loop is stored and the string bending system of the invention.
Figure 15:
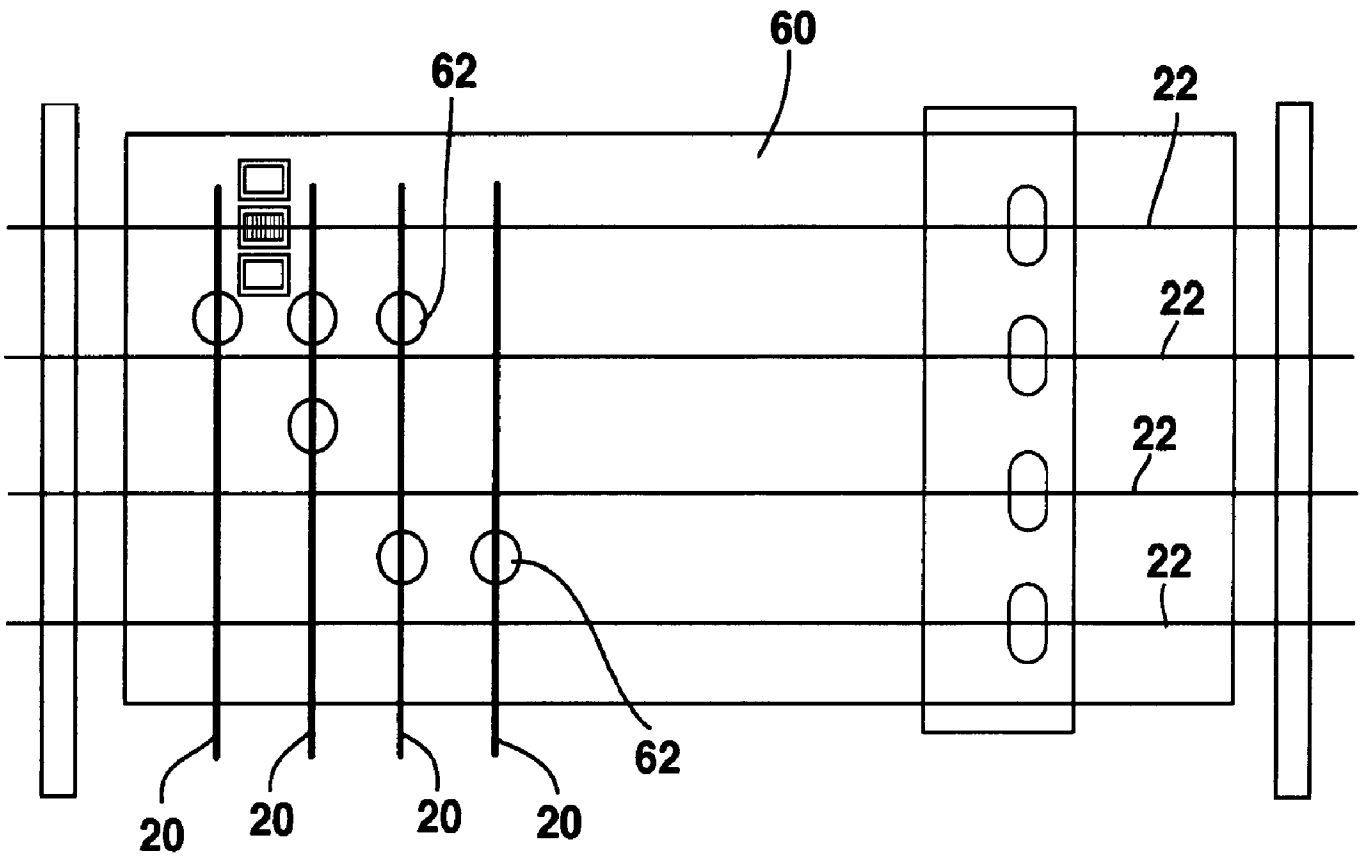
FIG. 15 is a close up top view of an embodiment of the present invention showing a printed template identifying under which notes a loop is stored
Figure 16:
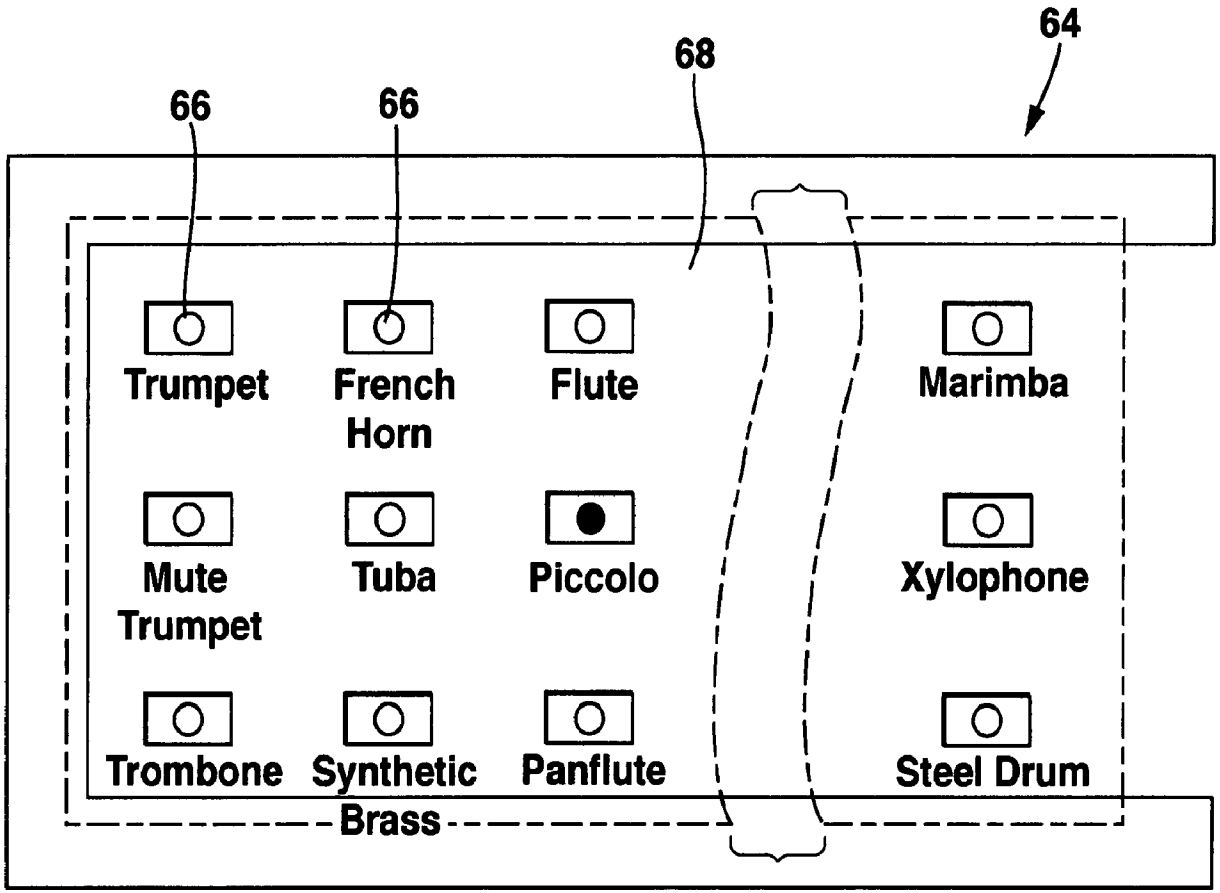
FIG. 16 is a close up front view of an embodiment of the present invention showing a panel used to indicate the choice of voices available along with the status of various control functions.

Note bending on the present musical device 10 is preferably accomplished by using infrared sensors 44 similar to the infrared sensors 32 to transmit IR light from a transmitter 46 that is reflected off a reflector 48 that is attached to one or more of the strings 22 back to a receiver 50 similar to receiver 36 (FIG. 14). A separate sensor 44 and reflector 48 is associated with each string 22. Each transmitter 46 is directed toward its corresponding reflector 48 so that as its associated string 22 is moved from a rest position to a stretched or "bent" position, the amount of light reflected off of the reflector 48 to the receiver 50 is changed. That is, as the string 22 is moved up or down, more or less reflected light is reflected off the reflector 48 and received by the receiver 50. The microprocessor 24 detects this change in the receipt of reflected IR light. As the amount of IR light detected by receiver 50 decreases, the microprocessor 24 interprets this reduction as a note being "bent" and decreases the note pitch in accordance to the amount of reduction in received IR light at the receiver 50. The reflector 48 can be a small piece of material such as a square of white that is mounted or painted on a piece of plastic. This piece of plastic has a groove in it that the string 22 goes through so that the reflector 48 moves when the string 22 moves. Some amount of hysteris can be added either mechanically (by using a slot slightly wider than the string 22) or by a software algorithm that is executed on the microprocessor 24

Other methods are possible to detect the deflection or tension of the string such as through the use of an assigned function that "bends" a note in response to activation through, for example, a bar 28 as will be explained in detail hereafter. Further, a roller bar such as bar 28*e* may be used in a similar fashion to a traditional pitchbend wheel.

In addition to combining some of the best elements of a guitar and piano while introducing new features, the musical device 10 has the advantage of being able to be produced at a lower cost than either a piano or guitar. This is because the techniques employed in the musical device 10 design utilize very low-cost components and there is not a critical mechanical aspect as on either a guitar or piano. Even an electronic keyboard will ordinarily cost more to produce because of the requirement to have so many moving parts (the keys), while on the musical device 10, there are few moving parts. Sensors 32 (IR transceivers) are also low cost because they are in mass production for use in applications such as consumer remote controls.

The preceding description of the musical device 10 provides many advantages over current musical instruments and produces an interesting and easy to play musical instrument. The musical device 10 also has several other innovative features that make the musical device 10 very easy to learn to play and offer advanced users an unprecedented level of control.

These features may be accessed by assigning functions to the actuation of notes, buttons, bars or any combination of these. For example, in the preferred embodiment of the music device 10 that includes bar 28, any note on the keyboard 14 may be assigned a function. But, in ordinary use activating a note is intended to produce the corresponding musical note. To activate the function corresponding to the note, the musician takes action to place the music device 10 in a function mode. In this function mode, activating a note does not produce the corresponding musical note. Instead, in this mode activating a note activates the function assigned to that note. For example, the note corresponding to the musical note middle "C" could be assigned the function of initiating a drum loop and the action to put the music device 10 into the function mode could be the depressing of the bar 28. Then, during a musical performance, when it is desired to active the function of loop triggering, the musician could depress a bar 28 with his thumb (e.g., bar 28*a*) thereby putting the music device 10 in the function mode and then touching the middle "C" note.

As mentioned above, these extra features are activated through the use of at least one bar 28 that operates in the fashion of a space bar on a conventional computer keyboard. In one embodiment, the bar 28 may be a thumb bar, foot switch or roller bar.

A particular advantage of using a bar 28 or bars 28 as described herein is that the use of such bars 28 eliminates the problem described above of removing notes from being able to be played to produce music in order to make them available to activate functions, loops or voices. Accordingly, the musical device 10 addresses this problem by temporarily providing an alternate function to the musical keys in a similar fashion to the common "shift" or "alt" keys on a computer ASCII keyboard. The use of a single shift key doubles the effective number of notes and functions and each additional shift key adds another complete set. In the musical device 10, the bars 28 act as these "shift" or "alt" keys. Consequently, it is expected that the invention will have multiple bars 28.

The thumb bar 28 preferably takes the form of a metal rod located on the front 16 of the main body 12 that is sensitive to touch along its length. In the preferred embodiment, the thumb bar 28 is a capacitive switch. In another embodiment, the bar 28 is a contact switch. In another embodiment, the bar 28 is a roller bar. It is clear that other types of switches could be used for the bar 28 as will occur to those skilled in the art so long as contact with the user's thumb and the bar 28 produces an electrical contact. Where the bar 28 is a foot switch, the foot switch is a standard device that can be plugged in to the musical device 10 and used to control the alternate functions. It may be desirable to have several bars 28 in similar form (e.g., all thumb bars or all foot switches) or a combination of forms (e.g., several thumb bars and one or more foot switches).

In concept, each bar 28 functions as a kind of "shift key". In the version of the musical device 10 shown, there are 96 note keys available (i.e., the intersections between the strings 22 with the spaces between adjacent frets 20) that essentially operate like switches. Throughout this description, a reference to a "note" or "playing a note" in connection with the activation of a function, means a user placing his or her finger on a string 22 in a location between a pair or frets 20. Of course, the size of the array formed by the strings 22 and frets 20 can be any desired size as formed by increasing or decreasing the number of strings 22 and the number of frets 20 or both. Depressing a bar 28 while playing a note changes the meaning of the depressed switch from that of a note to a trigger for another event such as another function or another note. In this way, in addition to the 96 note switches that are normally present on a conventional keyboard, there is an additional X times 96 functions available (where X is the number of bars 28) by using the thumb "shift keys" in the form of bars 28. In other words, each intersection of a string 22 and the space between adjacent frets 20 has X additional functions that can be easily accessed during the course of normal note playback by activating the appropriate bar 28. Where there are three bars 28 (so that X=3) there are four dimensions: (1) the note, (2) a function assigned to the "note" and activated by activating the first bar 28, (3) a function assigned to the "note" and activated by activating the second bar 28, and (4) a function assigned to the "note" and activated by activating the third bar 28.

This ability to have X functions assigned to a "note" may at first seem complex, but the following explanation should make clear the utility and ease of this defining characteristic by listing the functions that are accessed through use of the bars 28. For ease of describing the utility of bars 28, an embodiment of the invention having three bars 28 is described. Further, the bars 28 are thumb bars that are placed on the front 16 of main body 12 parallel to the fingerboard 14. In addition, several examples of functions that could be performed by the activation of the bars 28 are given.

Chords—In one embodiment, depressing a bar (e.g., the top thumb bar 28*a*) while playing a note could play a major chord that has the root of the depressed note. This function is an assigned function. As a result, any function could be assigned to the combination of playing a particular "note" and simultaneously activating the top bar 28*a*. The middle thumb bar 28*b* could be assigned to play the corresponding minor chord, and the bottom thumb bar 28*c* could be assigned to play a diminished chord.

Playing an additional note along with the root note could be assigned to allow for all the common chord combinations. For example, placing one finger on a C while another finger holds a note two frets 20 down could be assigned to play a $7^{th}$ chord. This makes it simple to play the chord accompaniment to most popular songs by learning a few easy to place finger positions. Any key can then be played simply by shifting the position left or right an appropriate amount. This allows users of the musical device 10 to have the ability to play chords for accompaniment and to play a melody on top of the chords. By contrast, it typically takes years of guitar lessons and practice to become proficient to this point; the musical device 10 shortens this process to a small fraction of the time.

Loops—In addition to operating in a chord mode as described above, the bars 28 may also operate in a control mode. In the control mode, the thumb bars 28*a-d* are used in a different way than in the chord mode described above. The top thumb bar 28*a* may be used to trigger "loops" which are pre-stored patterns of notes or drums. There is a large market for these loops and many existing and popular programs make it easy to generate them. These form the basis for computer programs such as Apple's Garage Band® or Sony's Acid Music® programs By triggering various combinations of loops, new songs can quickly be made by non-musicians that can sound very professional. The historical problem with this method of making music is that 1) It is not geared to a live performance and 2) the controls are either a keyboard/mouse or a separate control panel that is used to trigger the loops. The musical device 10 makes it possible to play back sophisticated sounding melodies that have the elements and expression of a live performance.

As any user of an electronic piano or synthesizer knows, the ability to play loops is not unique in that many keyboards have ways to active pre-stored melodies. The main difference here is that, by simply activating a bar (e.g., the top thumb bar 28*a*), 96 loops (or whatever the number of notes available on the musical device 10) can be easily accessed in the course of playing a melody. For example, with a typical consumer synthesizer, the user can activate a pre-stored song through contacting a separate switch then playing a live, user produces melody on top. This tends to sound boring and repetitive as the background is always the same and so is rarely used, especially in a live setting as it appears the user is simply activating a button to listen to "canned" music.

The musical device 10 retains the ability to easily produce songs in this way, but adds creative and dynamic control since, instead of a single setting for a song, there are up to 96 loop patterns that are easily accessible through the use of the thumb bar 28 while in the course of playing a piece. For example, there might be eight different drum patterns and eight bass patterns assigned to 16 note positions that can be selected during playback by activating a bar 28 while playing a note. These patterns can be made to automatically come in at the right time or can be triggered at any arbitrary moment while in the course of playback without moving the hands from the playing position. This is because the thumb is located near the thumb bars 28 so that a note can be played and then easily followed by a loop change by placing the thumb on the bar 28 and pressing another note on the fingerboard 14.

In currently available musical instruments, this ability to play loops is accomplished in two ways. The first way is by assigning synthesizer keys to be triggers of the patterns when activated by playing a note. But the problem with this method is that these keys are not then available to be used as notes. As a result, the note range can become severely restricted if more than a few patterns are desired.

A second method is to have a "MIDI control box" connected to the instrument that is an array of buttons, knobs and sliders that can be assigned to the loop trigger functions. The addition of these boxes is to get around the limitation of sacrificing a finite number of keys to activate these functions.

Sometime these buttons are integrated on a synthesizer. There are also external devices incorporating these arrays of buttons, knobs and sliders that can be used while playing a keyboard. Where such a MIDI control box is integrated into a synthesizer, use of the control box requires removal of the hands from the playing position. In either of these two methods for playing loops, practically speaking, there can be only a small number of buttons available for use as the triggers for the desired effects. Further, in either of these methods it is a distracting and non-musical way to interact with the controls when compared to the easy flow of producing music by playing a musical instrument.

MIDI controls—Those familiar with MIDI music generation know that the MIDI standard allows for a variety of controls that can be assigned to user-selectable functions. In a typical synthesizer, these controls consist of slide potentiometers or knobs mounted on the keyboard enclosure and there are separate MIDI controllers that can also provide an array of these knobs. While some musicians have become adept at moving sliders and pushing buttons with one hand while playing with the other, it is once again a nonmusical interface that is difficult to smoothly integrate into a performance, especially for a novice.

The bars 28 on the musical device 10 can be used to quickly select pre-defined switch functions during the course of playing a melody, as there are 96 functions available when the bars are depressed. A unique and important feature of the musical device 10 is that, instead of the note positions being just switches when the control bar 28 is depressed, any note position can also be a analog control that can function like a rotary knob or slide potentiometer.

One function that is particularly useful to musician performing electronically produced music is the ability to control a particular parameter with an analog to a potentiometer or a slider switch. For example, it may be desirable to make a note or series or group of notes louder at a particularly desired time. Volume switches made of a potentiometer or a slider switch are well known for controlling volume. However, these switches have the disadvantage that they are discrete elements that perform only a single function, take up space and are expensive In addition, these hardware slider controls can wear out over time.

In the present music device 10, a volume function can be assigned to a note or a pair of notes. When the music device 10 is put in the function activation mode, for example by depressing a thumb bar 28*a*, and a particular note is depressed, the function "Increase Volume" could be activated. Correspondingly, when the music device 10 is put in the function activation mode, for example by again depressing the thumb bar 28*b*, and a particular note paired to the first note is depressed, the function "Decrease Volume" could be activated. These functions could either be the move to or away from a preset volume level or could move toward or away from a volume level for as long as the bar 28 is activated.

The musical device 10 thus produces a virtual slider switch since, in the mode where the longer the user activates the note while in the function mode, the higher or lower the volume will be. This is analogous to moving a slider switch up or down or turning a potentiometer to control the volume. In this way, volume could be increased or decreased during a performance by the simple act of depressing a thumb bar 28 and a particular note. This method has the advantage of not requiring the addition of a discrete volume switch but instead uses the hardware already present in the music device 10.

Figure 12:
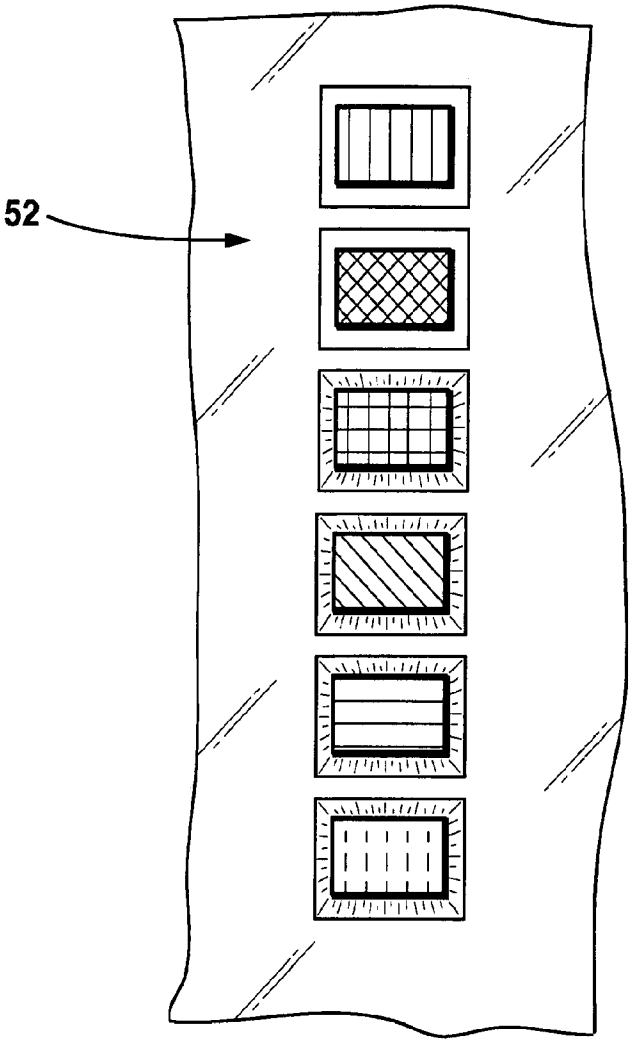
FIG. 12 is a close up front view of the LED array of the virtual potentiometers of the present invention.

With the system described above, functions, such as functions normally controlled by potentiometers or slider switches, can be controlled by virtual switches as described. But, it is desirable to be able to know where in the, range of the virtual potentiometer or slider switch the switch is at any given moment. In the preferred embodiment, this is done by including an RGB LED array 52 (FIG. 12). These are specialized LEDs that can be controlled to be any of a wide range of colors and intensities. This color range can be used to indicate the current level or position of the slider. For example, dark blue could be used to indicate the bottom of a range of values, while moving through the color spectrum to red will correspond to increasing values. A color mapping chart could be printed on the instrument. While this indication method does not serve as an exact parametric measurement, it can be very useful to indicate relative values. For example, where there are 16 MIDI channels available, a row of 16 sliders can represent the volume levels of each of the 16 possible MIDI channels. A look at the LED array 52 will then make immediately apparent the relative balance among the volume levels of the channels. Other configurations of the LED array 52 will occur to those skilled in the art. All of these configurations are intended to be part of an embodiment of the music device 10 as long as the current setting of the virtual slide potentiometer or switches are visually indicated by such LED array 52.

Figure 13:
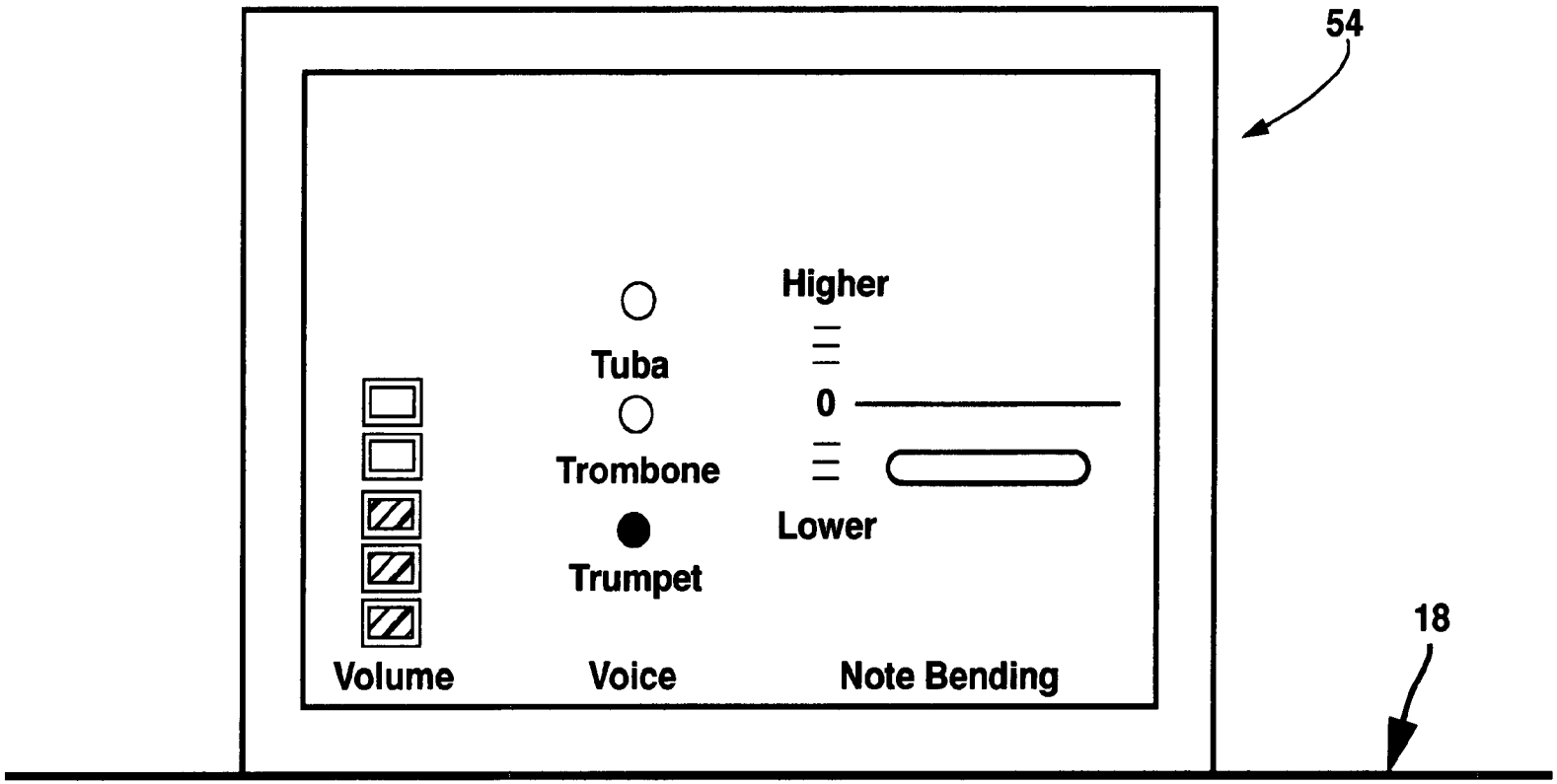
FIG. 13 is a close up front view of an LCD display of one embodiment of the present invention.

Although the preferred embodiment of displaying the current "setting" of the virtual potentiometer or slider switches is an LED array 52, other methods of displaying these current settings include, but are not limited to an alphanumeric display such as an LCD screen 54 (FIG. 13). When the musical device 10 is connected to a computer 26 (FIG. 9), the computer screen 56 can serve a number of display functions that are controllable by the musical device 10. A more expensive embodiment of the musical device 10 may include a larger LCD screen 54 as is commonly used in laptop computers. It is intended that any system that visually displays the current setting of the virtual potentiometer or switch may be used in the present music device 10.

MIDI electronic music makes it possible to select a variety of "voice" or instrument sounds. Modem computing power has made it possible to create completely realistic samples of actual instruments and because of the inexpensive memory now included in personal computers, a vast array of conventional and alternative sounds can be produced.

The ability to select voices on a MIDI instrument is certainly not unique to the musical device 10, but as with loops, it is the ability to select up to 96 voices "on the fly" while playing that is an advantage of the present music device 10. This is accomplished by using the bars 28 in a control mode. The bars 28 may be used to trigger the activation of a voice which is a particular sound such as a trumpet or a violin associated with the playing of a note. As a result, when a particular voice is selected and a note played, the note sounds like it was produced by the selected voice (e.g., the note sounds like it was produced by a trumpet).

Again, as any user of an electronic piano or synthesizer knows, the ability to select and play voices is not unique in that many keyboards have ways to select and play notes using voices. The main difference here is that, by simply activating a bar 28, 96 voices (or whatever the number of notes available on the musical device 10) can be easily accessed in the course of playing a melody. For example, the user could select a particular voice (e.g., trumpet) for the notes at the beginning of a musical piece. However, the user could desire to switch to another voice (e.g., trombone) at some point in the performance. This is easily accomplished by simply activating an appropriate bar 28 and playing a "note" corresponding to the trombone voice while that bar 28 is depressed. In addition, a particular voice can be made to automatically come in at the right time or can be triggered at any arbitrary moment while in the course of playback without moving the hands from the playing position. This is because the thumb is located near the thumb bars 28 so that a note can be played and then easily followed by a voice change by placing the thumb on the bar 28 and pressing another note on the fingerboard 14.

This may at first not seem particularly useful, as switching between conventional voices such as a trumpet and a clarinet during the playing of a musical phrase is not usually desirable. But the recent ability of computers to store large arrays of voices, along with the unique ability of the musical device 10 to seamlessly integrate voice changes in the course of playing, makes it possible to introduce a new form of musical expression.

An example of this is that a variety of guitar sounds can be stored as options for a single note—i.e. plucked softly, quickly, hammered or damped. Using the thumb bar 28, note "runs" can change on the fly to create the variety of intonations that are the hallmark of non-electronic instruments.

Of course, other functions could be assigned to this or any other note and could be activated by means other than depressing bar 28 with their thumb. For example, and without limiting the possible functions that will occur to skilled musicians and others skilled in the art, possible functions that could be assigned to notes include general-purpose MIDI "switch" commands that can be in turn used to control a wide variety of functions. This can include external control functions such as lighting or other interactive elements. Again, this functionality is part of the MIDI specification and can be accessed in current electronic instruments. But the instrument offers this functionality in the context of being easily accessible during the course of a performance. In addition, having all this functionality in a multi-purpose instrument is desirable over obtaining and maintaining many separate pieces of musical gear. Further, and without limiting the possible ways of activating there functions that will occur to skilled musicians and others skilled in the art, possible ways of activating these functions include foot pedals and conventional switches and sliders mounted on the instrument.

Where these functions are activated by using a control bar 28, the act of simply activated a bar 28 in the course of playing a piece naturally mimics the flow of producing music that musicians are used to and appreciate when playing conventional musical instruments. Of course, it can be a problem to keep track of what loops are stored where, but the present musical device 10 addresses this issue as described in detail hereafter.

In view of the foregoing, one of the most important aspects of the musical device 10 is that it enables the user to easily create original loops and songs. This ability to create a song is accessible even to someone without any musical training. As a result, the musical device 10 is designed to be playable immediately "out of the box" for people with no previous musical experience, but can be set to more advanced levels as the user increases in musical knowledge and proficiency.

This works in the following way. As described, the playing of a note on the fingerboard 14 combined with activating a bar 28 can be used to trigger a large variety of loop patterns. In the preferred embodiment, there will be a selection of these loops patterns provided with the musical device 10 and these patterns will be pre-arranged so as to be harmonious with each other. An example of these patterns would be a set of drum, bass, guitar, and keyboard phrases that are harmonious with each other. The complete beginner will start with triggering the template loops, functions or voices for different musical sounds and styles as described above that will be included with the instrument. The user can select among the patterns in real time and choose a set that is harmonious to the user. At his point, the combination of patterns can be stored in memory. This storage operation can be accomplished through the use of the thumb bars 28 that provide an alternate function (e.g., activation of the storage function) for a note.

For example, the top row of notes can be dedicated to storing patterns when one of the thumb bars 28 is pressed. This ability to store a sequence of patterns is similar in concept to the use of "macro" keys in a computer context. This macro pattern can then be recalled when an assigned note is pressed in conjunction with the appropriate bar 28. It can be seen that creating a sequence of these macro patterns can result in a complete song.

In the example given above, the top row of notes can be set to scan each stored pattern in sequence and an underlying LED as part of an LED array 58 will be illuminated to indicate progress through the song. Pattern1 would be the intro to the song, followed by pattern 2 immediately to the right and so on. The scanning sequence can be interrupted at any point to edit the song by substituting an alternate set of patterns in the correct scan position. This can be accomplished by choosing a desired pattern, voice, etc. and inserting it into the sequence, replacing one sequence with this new sequence or otherwise modifying the existing sequence with the new sequence. This method allows for complete beginners to create a song. This process of determining which LED in the LED array 58 to light and when is preferably controlled by the microprocessor 24 and associated software.

In the next skill level, the user can create individual patterns instead of using the templates included with the instrument. This is done through the easy-to-play method of entering and storing chords or individual notes as described above. Further, LEDs in the underlying LED array 58 associated with each note could be made to light up at appropriate times to suggest what notes will be harmonious with the current song being played (these indicators can also give a note-by-note sequence for those who wish to memorize a particular melody). As part of this skill level, notes that will not be harmonious with the current structure in the song can be disabled so as to eliminate musical "mistakes". This function can be disabled as the user advances The beginning and ending of the patterns that are input and optionally stored by the user can be easily done because of the thumb bars 28 (or foot pedals) that provide a method of control without lifting the fingers from the playing position. It can be seen that a completely original song can be created by making patterns of the different notes, and instruments in this way and voices and other expression can be added while performing or during the editing process. A microphone jack can also be included on the musical device 10 so as to allow for external voice or sound input to be included in the available patterns. While much of this functionality is available by combining other instruments and equipment, the advantage of the musical device 10 is that is contains a multiplicity of these functions in one compact and easily accessible way that can be easily accessed in the context of a live performance.

As described above, the musical device 10 is able to "bend" notes to mimic the action of note bending that is able to be performed on a guitar. In one embodiment as described above, the musical device 10 accomplishes this note bending through the use of sensors 32 with transmitters 34 and receivers 36 associated with each string 22 that can detect the amount that the string 22 is "bent" or pushed one way or another. However, as briefly mentioned above, in another embodiment of the musical device 10, this note bending may be accomplished through the activation of an assigned "note bending" function that is preferably activated through a control bar 28. Then the control bar 28 is depressed or otherwise activated, the note that is being played by the user at the time the bar 28 is varied in pitch by a predetermined amount or may be bent and unbent over time according to the parameters assigned to the note bending function. Further, the amount, timing and direction of the note bending achieved by activating a first control bar 28 may itself be controlled by activating and maintaining activation on a second bar 28.

Apart from the usefulness of the bars 28 to allow a larger amount of control sliders and switches available than are known to be found on any other device, this feature opens up new creative possibilities for the more advanced user. For example, during the course of playing a melody, the string 22 bend function can be used in the conventional way of altering the pitch as described above. But, if another control bar 28 is depressed, an alternate way of changing tonality of the sound can be selected even while the first bar 28 is being depressed to cause the pitch bend. This provides users of the electronic musical device 10 the same degree of control over sound variations that in traditional instruments are the defining characteristics of artistic expression.

Display—loop functions. As mentioned above, keeping track of the multiple functions and effects that can be accessed through the bars 28 can be a complex task. It is not expected that users will really use all X by 96 functions that are accessible (which could be an extremely large number where X is two or more). It is anticipated that a beginner will only need a small fraction of these functions to enhance a performance.

However, even a relatively small number of sample loops, functions or voices require some method of identifying under which notes the sample loops, functions or voices are stored and it would be helpful to have a way of recalling some description of the loop, function or voice located there. These are really two separate problems. The first problem, identifying under which note a loop, function or voice is stored, is preferably addressed through an array of LEDs 58 (FIG. 14) that are located beneath each note positions (one for each note position). These LEDs 58 are preferably different colors so as to more easily locate and arrange loop, function or voice categories. In the preferred embodiment, there are 12 different-color sets of 8 LEDs 58 (that have the same color within the set). These are used to group similar loops, functions or voices in an easy-to-locate way.

For example, there might be 8 drum loops stored within the array of 8 blue LEDs 58, while 8 bass patterns might be stored within the next row of yellow LEDS 58. The particular pattern that is currently playing can be easily seen because its associated LED 58 is illuminated. Other keys that have patterns stored in them may still be illuminated to indicate that they are not empty, but at a dimmer level.

This method makes it easy to identify where the loop patterns, functions or voices are stored and what category they are in, but doesn't solve the problem of having a way to describe the pattern, function or voice itself. For example, with 8 drum patterns it may be unnecessary to have a written description of each pattern, but it can be useful to have some simple way of describing the differences among the patterns. There is no practical way to inscribe this information on the fingerboard 14, but an additional display 60 (FIG. 15) will accomplish this. For loop patterns, functions or voices, this display 60 consists of a sheet of paper, cardboard, plastic or metal that is organized in the same grid pattern that is in the fingerboard 14 and is a one-to-one mapping of the note position with a loop, function or voice description. Pre-printed sheets or templates of paper, cardboard, plastic or metal can be marked by the user on a note with descriptive information 62 about the loop, function or voice and inserted in this area or such a template could be provided to a common printer associated with a personal computer-based word processor to make a user-customizable description of favorite loop patterns, functions or voices.

Although the preferred method of identifying under which notes the sample loops, functions or voices are stored is through an array of LEDs 58 that are located beneath each note positions, other methods of identifying the location of the sample loops may be used. Examples of such methods include, but are not limited to the use of a computer display screen when the unit is connected to a desktop or laptop computer. An integral LCD display 52 such as that shown in FIG. 13 can also provide visual status on the active loops, functions or voices.

Display. A separate panel 64 (FIG. 16) may be used to indicate the choice of loops, functions or voices available along with the status of various control functions. Since the user can define most of these functions, there must be a way to easily change this information. This can be done through the computer 26 the musical device 10 may be connected to. But, alternately, a small panel 62 may be available located on the top 18 of the main body 12 that will be lit with indicator status lights 66. The actual functions shown will be on a template 68 that is a normal piece of paper, cardboard, plastic or metal that can be marked on or printed by the user with a template that is provided. A beginner will not initially need to define custom functions so that a standard template for beginners can be provided. Alternately, the separate panel 64 could take the form of an LCD screen or similar screen.

The ability to synchronize the loop patterns is a key component of the loop playback and creation function previously described. An advanced user might not want to use this function. Consequently, it is possible for the user to disable the synchronization functions. But, it is believed to be too much to expect that a beginner will initially have the skill to synchronize these loop functions. Accordingly, in the preferred embodiment of the invention, the software that is included with the musical device 10 and implemented by the microprocessor 24 will have the ability to automatically synchronize the loop patterns that are triggered by the user.

Figure 17:
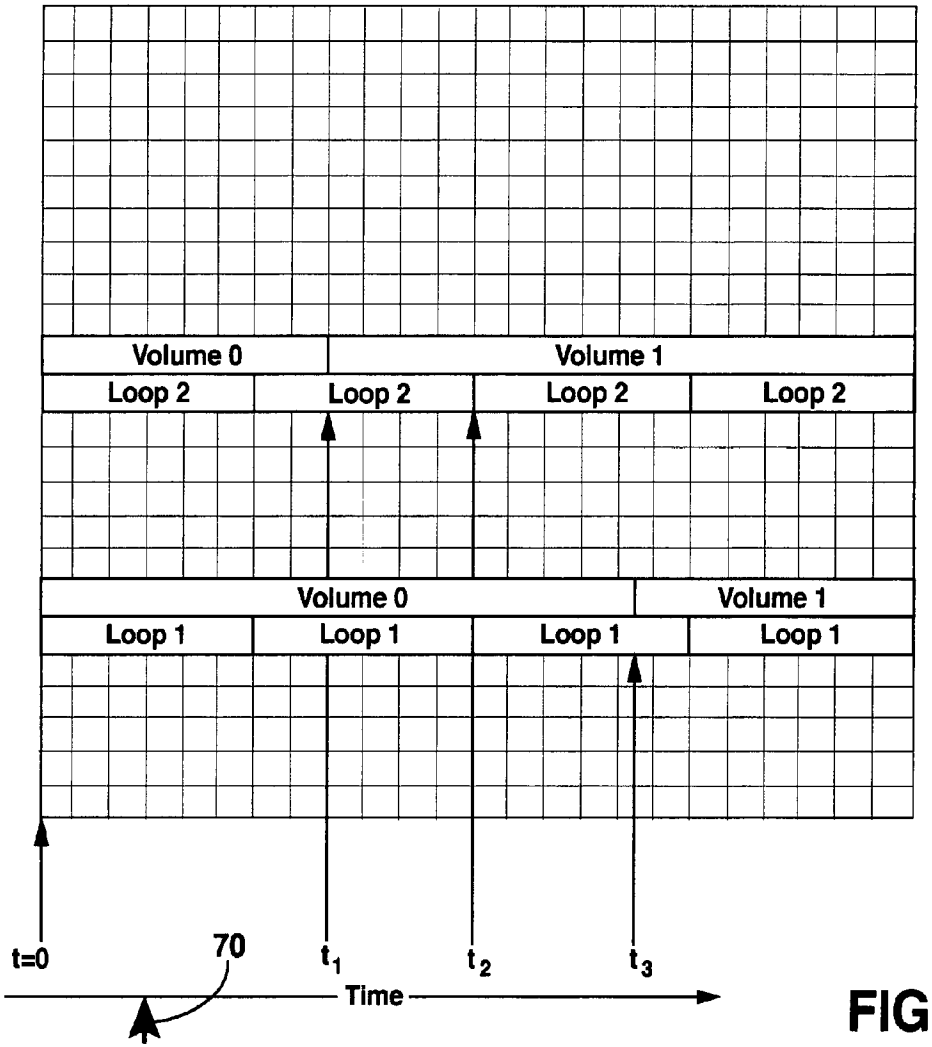
FIG. 17 is a timing diagram showing the timing by software of loops to synchronize such timing.

The software will accomplish this by starting all the patterns at the same time (FIG. 17). A software time pointer 70 advances through time driven by clock pulses of the microprocessor 24. When non-activated or non-triggered patterns are started (e.g., Loop 1 and Loop 2), there will be no sound produced as the patterns will be muted or playing a "zero-volume" file. The timing pointer 70 will advance and be tracked by the software so that when a loop is triggered (e.g., Loop 2 at $t_1$), the volume for this pattern will immediately be raised and will consequently be heard beginning at time $t_1$ instead of waiting for the loop to repeat beginning at $t_2$. But, the volume for the non-triggered loop (Loop 1 in this example) will remain at the zero-volume level.

If a non-activated loop is triggered (e.g., Loop 1 at $t_3$), loop playback for Loop 1 will commence (i.e., the volume for Loop 1 will be raised so that Loop 1 can be heard) at the time Loop 1 is activated ($t_3$). Because Loop 1 and Loop 2 were started at the same time (t=0) and consequently were already essentially playing in the background (albeit initially at a zero volume level) and aligned with each other from the beginning of the relevant time (i.e., from t=0), playback (i.e., an increase in volume) for an activated loop may begin immediately at a point when the user desires to activate the loop which loop will already be aligned in time with all other currently-playing patterns (instead of beginning the playing of the loop at the time it is activated, which would result in a misalignment of the activated loop with currently-playing loops). For example, Loop 2 is a six measure loop pattern that is started at one point in time (t=0) at zero volume along with all the other associated loops at zero volume. This is normally done at the beginning of a song selection. Loop2 in this example is a six measure loop that will continually play for six measures and then repeat. If at some arbitrary time, (e.g., 2.25 measures into this repeat pattern) the Loop 2 pattern is activated by the user playing the appropriate note while at the same time contacting the appropriate bar 28, the software would immediately raise the volume of the Loop 2 pattern until the end of the current pattern. Thereafter, the Loop 2 pattern would repeat at this raised volume until the volume for this Loop 2 is either changed or deactivated.

In this example, if another loop pattern is activated (e.g., the Loop 1 pattern, also a six measure pattern) at some arbitrary time $t_3$, the software would immediately raise the volume of the Loop 1 pattern. Since the timing pointer 70 has kept track of the master time that all loops are referenced to, the Loop 1 pattern will be in sync with the Loop2 pattern, exactly as if they were both started at full volume at t=0. This is very different than the normal means of triggering a collection of loops that will commence playback at the beginning of the loop when a trigger event occurs. The master tracking pointer ensures that, as long as the loops are prepared in such a way that they would be synchronized if they are all started with full volume at the same time, they will sound synchronized if they are triggered at any arbitrary point in time by modulating the volume from zero to the desired loudness at that point in time. Thus the loop trigger event essentially acts as a volume modulation gate instead of a "loop start" command.

With this method, the user is not required to have an exact sense of musical timing. Instead, any time a pattern trigger is pressed (e.g., by playing a preassigned note and pushing a bar 28 at the same time), the playback of this loop pattern will be automatically synchronized and so will be appropriately matched to the current pattern or patterns being played. Even with this automatic method, there is still a good deal of creativity to be exercised by the user since the musical sound will vary depending on what patterns are selected and when the patterns are selected to start playback. Muting a pattern in this context (such as turning off a lead guitar) reverts to the zero-volume pattern so as to be ready for the next trigger event to be synchronized.

Because the instrument has the ability to integrate control functions into note manipulation, it is uniquely easy to "layer" loop patterns in the context of a live performance. Since the beginning and the end of a pattern can be initiated at any time and stored without the hands leaving the playing position, it becomes possible to store a loop "on-the-fly" and then play another loop while the just-stored loop is playing. This makes it possible to create intricate harmonies that are woven together in a live performance.

The musical device 10 thus allows the user to perform a variety of musically desirable tasks during a musical performance due to the ease of playing the musical notes and accessing the functions, loops and voices of the musical device 10. The use of the bars 28 allows the user to active these functions, loops and voices in a manner that is not distracting to the user or that requires the user to hunt for the appropriate keys. The use of bars 28, including the use of bars 28 through a foot switch, applies not only to the fingerboard 14 of the present invention, but may also be used on other MIDI controllers including but not limited to MIDI controller associated with keyboards, synthesizers and guitar controllers.

There are many materials and configurations that can be used in constructing the invention that will be clear to those skilled in the art including, without limitation, alternate body arrangements, varying numbers of strings and frets, various loops, functions and voices and varying interfaces to computers, game platforms and MIDI equipment. In addition, it is clear than an almost infinite number of minor variations to the form and function of the disclosed invention could be made and also still be within the scope of the invention.

Further, it is clear that the electronics of the musical device 10 including the microprocessor 24, in whatever embodiment of the musical device 10, may be contained entirely within the main body 12 or may be located in one or more discrete pieces, including a computer 26, that is attached to the main body 12 and more specifically is connected to and interacts with the fingerboard 14. Consequently, the location of such electronics or whether an integral device or a series of discrete devices ultimately produce the sounds as a result of a user's interaction with the fingerboard 14 is not intended to be a limitation on this invention.

Consequently, it is not intended that the invention be limited to the specific embodiments and variants of the invention disclosed. It is to be further understood that changes and modifications to the descriptions given herein will occur to those skilled in the art. Therefore, the scope of the invention should be limited only by the scope of the claims.

What is claimed is:

1. A stringed musical apparatus, the apparatus comprising:

a series of strings and frets configured to produce musical notes when activated by a user, the strings running perpendicular to the frets to form a series of string and fret locations;

an IR transmitter associated with each string and fret location of the musical device used to produce sound;

at least one IR receiver corresponding to each IR transmitter; and a system, connected to the at least one IR transmitter and each IR receiver, for causing each of the at least one IR transmitters to emit IR light and for determining whether each corresponding IR receiver is receiving IR light;

wherein IR light is emitted by an IR transmitter and is reflected back to and detected by its corresponding IR receiver when a user's body part moves near the at least one string and fret combination of the musical device to produce sound; and wherein the IR light detected by the corresponding IR receiver causes the musical device to activate loops, functions or voices corresponding to movement of the user's body part.

2. The musical device of claim 1 wherein the system for causing each of the at least one IR transmitters to emit IR light and for determining whether each corresponding IR receiver is receiving IR light is a multiplexing system connected to each IR transmitter and to each IR receiver wherein an IR transmitter is activated by the multiplexing system to emit IR light and each corresponding IR receiver is checked by the multiplexing system to see whether IR light is being received by the IR receiver whereby IR light emitted from an IR transmitter is reflected of the user's body part back toward the corresponding IR receiver and detected by that IR receiver.

3. The musical device of claim 2 wherein the multiplexing system is implemented by a microprocessor.

4. The musical device of claim 1 further comprising means for determining the speed at which a user's body part moves near the element of the musical device to produce sound and means for correlating the speed with an activity.

5. The musical device of claim 4 wherein the means for determining the speed includes:

(a) a system for determining when a first threshold of IR light has been detected by the IR receiver and when a second threshold or IR light has been detected by the IR receiver;

(b) a timer to determine the time between when the a system for determining when a first threshold of IR light has been detected by the IR receiver and when a second threshold of IR light has been detected by the IR receiver determines that a first threshold of IR light has been detected by the IR receiver and a second threshold or IR light has been detected by the IR receiver;

(c) means, in response to the time determined by the timer between when a first threshold of IR light has been detected by the IR receiver and when a second threshold of IR light has been detected by the IR receiver, for determining the speed that the user's body part moves near the element of the musical device.

6. The musical device of claim 5 wherein the means for determining the speed that the user's body part moves near the element of the musical device is a microprocessor.

7. In a musical device requiring a user to physically contact a string of the musical device to produce sound directly or indirectly, an apparatus for determining that such contact has been made comprising:

at least one IR transmitter associated with the string of the musical device to produce sound;

at least one IR receiver corresponding to an at least one IR transmitter; and a system, connected to the at least one IR transmitter and the at least one IR receiver, for causing each of the at least one IR transmitters to emit IR light and for determining whether each corresponding IR receiver is receiving IR light;

wherein IR light is emitted by an IR transmitter and is returned from a user's body part back to and detected by its corresponding IR receiver when the user's body part moves near the string of the musical device to produce sound.

8. The musical device of claim 7 wherein the system for causing each of the at least one IR transmitters to emit IR light and for determining whether each corresponding IR receiver is receiving IR light is a multiplexing system connected to each IR transmitter and to each IR receiver wherein an IR transmitter is activated by the multiplexing system to emit IR light and each corresponding IR receiver is checked by the multiplexing system to see whether IR light is being received by the IR receiver whereby IR light emitted from an IR transmitter is reflected of the user's body part back toward the corresponding IR receiver and detected by that IR receiver.

9. The musical device of claim 8 wherein the multiplexing system is implemented by a microprocessor.

10. In a musical device requiring a user to physically contact a string of the musical device to produce sound directly or indirectly, an apparatus for confirming that such contact has been made comprising:

at least one IR transmitter associated with the string of the musical device to produce sound;

at least one IR receiver corresponding to an at least one IR transmitter; and a system, connected to the at least one IR transmitter and the at least one IR receiver, for causing each of the at least one IR transmitters to emit IR light and for determining whether each corresponding IR receiver is receiving IR light;

whereby IR light is emitted by an IR transmitter and is received back to and detected by its corresponding IR receiver when a user's body part moves near the string of the musical device to produce sound.

11. The musical device of claim 10 wherein the system for causing each of the at least one IR transmitters to emit IR light and for determining whether each corresponding IR receiver is receiving IR light is a multiplexing system connected to each IR transmitter and to each IR receiver wherein an IR transmitter is activated by the multiplexing system to emit IR light and each corresponding IR receiver is checked by the multiplexing system to see whether IR light is being received by the IR receiver whereby IR light emitted from an IR transmitter is reflected of the user's body part back toward the corresponding IR receiver and detected by that IR receiver.

12. The musical device of claim 11 wherein the multiplexing system is implemented by a microprocessor.

13. In a musical device requiring a user to physically contact a string of the musical device to produce sound directly or indirectly, a method for confirming that such contact has been made comprising the steps of:

A) providing an apparatus comprising:

(i) at least one IR transmitter associated with the string of the musical device to produce sound;

(ii) at least one IR receiver corresponding to an at least one IR transmitter; and (iii) a system, connected to the at least one IR transmitter and the at least one IR receiver, for causing each of the at least one IR transmitters to emit IR light and for determining whether each corresponding IR receiver is receiving IR light;

B) emitting IR light by the at least one IR transmitter; and

C) detecting, by the IR receiver corresponding to the IR light of step B, that IR light reflected off a user's body part as the user's body part moves near the string of the musical device to produce sound has exceeded a predetermined threshold.

14. In a musical device requiring the user to physically contact at least one of a plurality of strings of the musical device to produce sound directly or indirectly, a method for determining that such contact has been made comprising the steps of:

A) providing an apparatus comprising:

(i) at least one IR transmitter associated with each string of the musical device used to produce sound;

(ii) at least one IR receiver corresponding to each IR transmitter; and (iii) a system, connected to each IR transmitter and each IR receiver, for causing each of the at least one IR transmitters to emit IR light and for determining whether each corresponding IR receiver is receiving IR light;

B) emitting IR light by the at least one IR transmitter;

C) detecting, by the IR receiver corresponding to the IR light of step B, the IR light reflected off a user's body part as the user's body part moves near the string of the musical device to produce sound:

D) activating loops, functions or voices corresponding to movement of a user's body part.

15. A musical device, the device comprising:

a plurality of strings and a plurality of frets configured to produce music, by contacting one or more strings in association with one or more pairs of frets; and an apparatus configured to detect that the one or more strings has been contacted, including:

a plurality of sensors, the sensors each including a light transmitter and a light receiver configured to receive the light produced by the light transmitter, the sensors located at locations defined by the intersection of each string with a space between each pair of frets; and a processor coupled to the sensors and configured to, detect whether the light receivers are receiving light generated by the light transmitters;

detect light from a body part of a user as the user contacts the one or more strings; and activate at least one of a plurality of musical loops upon detecting the user contacting the one or more strings;

wherein the light detected from the body part of the user originates from the light transmitters.

16. The musical device of claim 15, wherein the processor is configured to:

initiate the playback of a first musical loop starting at a volume level of zero;

initiate the playback of a second musical loop starting at a volume level of zero;

synchronizing in time the playback of the first musical loop and the playback of the second musical loop;

activate the first musical loop upon detecting the user contacting a first combination of strings and associated pairs of frets, the activating the first musical loop including raising the volume level to a non-zero level; and activate the second musical loop upon detecting the user contacting a second combination of strings and associated pairs of frets, the activating the second musical loop including raising the volume level to a non-zero level.

17. The musical device of claim 16, wherein the processor is configured to de-activate the first musical loop upon detecting the user contacting a third combination of strings and associated pairs of frets, the de-activating including setting the volume level to zero and continuing playback of the first musical loop in synchronization with the second musical loop.

18. The musical device of claim 15, wherein the processor is configured to use a master tracking pointer to keep the plurality of loops synchronized.

19. The musical device of claim 18, wherein the processor is configured to de-activate an active loop upon detecting the user repeating the string and fret combination that activated the loop, the de-activating including setting the volume level of the de-activated loop to zero and continuing playback of the de-activated loop synchronized with the plurality of loops.

20. The musical device of claim 18, wherein the processor is configured to keep both active loops and de-activated loops of the plurality of loops synchronized until any individual loop of the plurality of loops is canceled.

* * * * *

UNITED STATES PATENT AND TRADEMARK OFFICE

CERTIFICATE OF CORRECTION

PATENT NO. : 8,022,288 B2
APPLICATION NO. : 12/548849
DATED : September 20, 2011
INVENTOR(S) : Daniel E. Sullivan It is certified that error appears in the above-identified patent and that said Letters Patent is hereby corrected as shown below:

In column 23, line 7, in Claim 5, after “when” delete “the”.

In column 24, line 57, in Claim 14, delete “sound:” and insert -- sound; --, therefor.

Signed and Sealed this
Sixth Day of December, 2011

David J. Kappos

David J. Kappos
*Director of the United States Patent and Trademark Office*